US006676252B2

(12) United States Patent
Bilotta et al.

(10) Patent No.: US 6,676,252 B2
(45) Date of Patent: Jan. 13, 2004

(54) PRINTER INK CARTRIDGE AND METHOD OF ASSEMBLING SAME

(75) Inventors: Michael F Bilotta, Fallbrook, CA (US); Antonio Cruz-Uribe, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/132,489

(22) Filed: Apr. 24, 2002

(65) Prior Publication Data

US 2003/0202060 A1 Oct. 30, 2003

(51) Int. Cl.[7] ..... M41J 2/175
(52) U.S. Cl. ..... 347/86; 347/85
(58) Field of Search ..... 347/85, 86, 87

(56) References Cited

U.S. PATENT DOCUMENTS

| | | | | |
|---|---|---|---|---|
| 4,381,946 A | | 5/1983 | Uehara et al. | |
| 4,500,895 A | | 2/1985 | Buck et al. | |
| 4,771,295 A | | 9/1988 | Baker et al. | |
| 4,794,409 A | | 12/1988 | Cowger et al. | |
| 5,278,584 A | | 1/1994 | Keefe et al. | |
| 5,283,593 A | * | 2/1994 | Wehl | 347/86 |
| 5,425,478 A | * | 6/1995 | Kotaki et al. | 222/501 |
| 5,675,375 A | | 10/1997 | Riffee | |
| 5,721,576 A | * | 2/1998 | Barinaga | 347/85 |
| 5,874,976 A | | 2/1999 | Katon et al. | |
| 5,929,883 A | | 7/1999 | Gunther et al. | |
| 5,992,985 A | * | 11/1999 | Young et al. | 347/85 |
| 6,113,229 A | | 9/2000 | Gunther et al. | |
| 6,120,132 A | | 9/2000 | Coiner et al. | |
| 6,149,266 A | | 11/2000 | Cook | |
| 6,231,168 B1 | | 5/2001 | Maze et al. | |
| 6,241,349 B1 | | 6/2001 | Harvey et al. | |
| 6,286,950 B1 | | 9/2001 | Altendorf et al. | |

FOREIGN PATENT DOCUMENTS

EP 1090767 A1 4/2001

OTHER PUBLICATIONS

HP Journal, Aug. 1988, pp 1–88.

* cited by examiner

*Primary Examiner*—Anh T.N. Vo
(74) *Attorney, Agent, or Firm*—Walter S. Stevens

(57) ABSTRACT

Printer ink cartridge and method of assembling same. The cartridge comprises a shell formed by a wall defining a cavity in the shell for storing ink. Disposed in the shell is a print head for ejecting ink drops through ink ejection orifices formed in the shell. The shell also defines an inlet port through the wall for allowing access to the cavity. An elastomeric seal or septum is matingly disposed in the port for sealing the port, the septum having a slit centrally therethrough for receiving an ink supply needle. A removable barrier is interposed between the cavity and the septum during manufacture of the cartridge. The barrier covers the port for isolating the ink in the cavity from the septum in order to avoid chemical interaction between the ink and the septum. During refilling of the cartridge, the ink supply needle is received through the slit and pushes the barrier from the port to allow refill ink to be supplied into the cavity.

31 Claims, 20 Drawing Sheets

PRINTER INK CARTRIDGE AND METHOD OF ASSEMBLING SAME

BACKGROUND OF THE INVENTION

This invention generally relates to inkjet printers and methods and more particularly relates to an inkjet printer cartridge and method of assembling same, the cartridge being adapted to avoid chemical interaction between ink stored in the cartridge and a seal sealing the cartridge.

An inkjet printer produces images on a recording medium by ejecting ink droplets onto the recording medium in an image-wise fashion. The advantages of non-impact, low-noise, low energy use, and low cost operation in addition to the ability of the printer to print on plain paper are largely responsible for the wide acceptance of ink jet printers in the marketplace.

More specifically, an ink jet printer comprises an inkjet printer cartridge that includes a plurality of ink ejection chambers and a plurality of ink ejection orifices in communication with respective ones of the ink ejection chambers. At every orifice a heat actuated ink ejector, such as found in thermal ink jet printers, is used to produce an ink droplet. In such thermal ink jet printers, a heater locally heats the ink body and a quantity of the ink phase changes into a gaseous steam bubble. The steam bubble raises the internal ink pressure sufficiently for an ink droplet to be expelled through the ink ejection orifice and toward the recording medium. Thermal inkjet printers are well-known and are discussed, for example, in U.S. Pat. Nos. 4,500,895 to Buck, et al.; U.S. Pat. No. 4,794,409 to Cowger, et al.; U.S. Pat. No. 4,771,295 to Baker, et al.; U.S. Pat. No. 5,278,584 to Keefe, et al.; and the Hewlett-Packard Journal, Vol. 39, No. 4 (August 1988), the disclosures of which are all hereby incorporated by reference.

The inkjet printer cartridge itself may be a carriage mounted printer cartridge that reciprocates transversely with respect to the recording medium (i.e., across the width of the recording medium) as a controller connected to the printer cartridge selectively fires individual ones of the ink ejection chambers. Each time the printer cartridge traverses the recording medium, a swath of information is printed on the recording medium. After printing the swath of information, the printer advances the recording medium the width of the swath and the printer cartridge prints another swath of information in the manner mentioned immediately hereinabove. This process is repeated until the desired image is printed on the recording medium. Alternatively, the printer cartridge may be a page-width printer cartridge that is stationary and that has a length sufficient to print across the width of the recording medium. In this case, the recording medium is moved continually and normal to the stationary printer cartridge during the printing process.

Inks useable with thermal inkjet printers, whether those printers have carnage-mounted or page-width printer cartridges, are specially formulated to provide suitable images on the recording medium. Such inks typically include a colorant, such as a pigment or dye, and an aqueous liquid, such as water, and/or a low vapor pressure solvent. More specifically, the ink is a liquid composition comprising a solvent or carrier liquid, dyes or pigments, humectants, organic solvents, detergents, thickeners, preservatives and other components. Moreover, the solvent or carrier liquid may be water alone or water mixed with water miscible solvents such as polyhydric alcohols, or organic solvents. Various liquid ink compositions are disclosed, for example, by U.S. Pat. No. 4,381,946 titled "Ink Composition For Ink-Jet Recording" issued May 3, 1983 in the name of Masafumi Uehara, et al.

The printer cartridge includes a central cavity that is filled with ink of a predetermined color during manufacture of the cartridge. Composition of the cartridge walls may comprise polyethylene naphthalate, which is known to be resistant to corrosive effects of ink materials. The terminology "corrosive effect" means chemical deterioration when the ink comes in contact with a material. The printer cartridge also includes an inlet aperture in communication with the cavity for allowing the cavity to be filled with the ink. Disposed in the inlet aperture is an elastomeric seal that seals the aperture, so that the ink does not exit the cavity through the aperture after being filled with ink. The composition of the elastomeric seal may comprise constituents, such as silicone rubber with zinc oxide and stearic acid as additives. An exemplary inkjet printer cartridge is disclosed more fully, for example, by U.S. Pat. No. 6,113,229 titled "Interchangeable Fluid Interconnect Attachment And Interface" issued Sept. 5, 2000, in the name of Max Stephen Gunther, et al. and assigned to the assignee of the present invention, the disclosure of which is hereby incorporated by reference.

As a step in manufacture of the cartridge, an adhesive tape is placed over the exterior of the ink ejection orifices to prevent ink leaking from the orifices during packaging, shipment and storage of the newly manufactured cartridge. The composition of the adhesive tape exposed to the ink adjacent to the ink ejection orifice may comprise zinc stearate as a constituent. After manufacture, the cartridge is packaged and typically shipped to a retailer or distributor of such cartridges whereupon the cartridge may be stored for a period of time, such as several months, prior to delivery to an end user of the cartridge. Of course, before placing the cartridge in the printer carriage, the end user manually removes the adhesive tape covering the ink ejection orifices, so that ink can be ejected from the cartridge during the printing process.

During printing, the ink in the cartridge cavity is gradually depleted. When sufficiently depleted, the cartridge is discarded and replaced with another cartridge containing ink. However, the heat actuated ink ejector typically remains operable even after depletion of the ink in the cartridge. In other words, the heat actuated ink ejector has useful operational life remaining although the ink in the cartridge is depleted. This has given rise to an after-market in which used cartridges are refilled, resold and re-used. This has also given rise to development of inkjet printer systems using an external ink supply reservoir connectable to the depleted cartridge for refilling the cartridge by means of a hollow ink supply needle. The needle is capable of piercing the seal to inject ink into the cavity formed in the cartridge.

However, it has been observed that during storage of the newly manufactured ink cartridge, the ink in the cavity may chemically interact with the zinc oxide and stearic acid constituents of the seal that seals the cartridge cavity. Over time, the ink leaches the zinc oxide and stearic acid from the seal to form zinc stearate crystals in the ink in the cavity. These zinc stearate crystals then migrate to the ink ejection orifices to clog or block the ink ejection orifices. However, the precise mechanism by which the zinc stearate crystals form is not completely understood. In this regard, zinc stearate may instead remain in solution (i.e., dissolved) in the ink in the cavity and only form crystals on the adhesive tape covering the orifices. In this instance, the crystals may accumulate in the orifices to clog or block the orifices. In any event, it is undesirable to block the ink ejection orifices. It is undesirable to block the ink ejection orifices because blocking the ink ejection orifices interferes with proper ejection of ink drops during printing. Thus, it would be desirable to avoid chemical interaction between the ink and the seal during shipment and prolonged storage. Consequently, a problem in the art is chemical interaction between the ink and the seal.

Therefore, what is needed is an inkjet printer cartridge adapted to avoid chemical interaction between ink stored in the cartridge and a seal sealing the cartridge.

SUMMARY OF THE INVENTION

In its broad form, the present invention comprises a printer ink cartridge comprising a shell defining a cavity and a port; a seal spanning the port; and a barrier interposed between the cavity and the seal for isolating the cavity from the seal. In this manner, the inkjet printer cartridge is adapted to avoid chemical interaction between ink stored in the cartridge and the seal sealing the cartridge.

According to an aspect of the present invention, the printer ink cartridge comprises a shell formed by a wall defining a cavity in the shell for storing ink. Disposed in the shell is a print head for ejecting ink drops through corresponding ink ejection orifices formed in the shell. These ink drops are ejected during printing to form an image on a recording medium. The shell also defines an inlet port through the wall for allowing access to the cavity. An elastomeric seal or septum is matingly disposed in the port for sealing the port, the septum having a first surface and a second surface and a slit centrally therethrough extending from the first surface to the second surface. The purpose of the slit is to sealably receive an ink supply needle during refilling of the cartridge.

However, during prolonged shipment and storage of a newly manufactured cartridge, the ink in the cavity may chemically interact with the septum to form crystals that accumulate in the ink ejection orifices to block the orifices. Accumulation of such crystals in the ink ejection orifices is undesirable because such accumulation of crystals interferes with proper ejection of ink droplets during printing.

Therefore, according to the invention, a movable barrier is interposed between the cavity and the septum during manufacture of the cartridge. The barrier covers the port for isolating the ink in the cavity from the septum in order to avoid chemical interaction between the ink and the septum. The barrier preferably remains covering the port until it is required to refill the cartridge with ink. That is, during refilling of the cartridge, the ink supply needle pushes the barrier after the needle is received through the slit in the septum. The barrier moves as the needle pushes the barrier. As the barrier moves, it will move away from the port in order to uncover the port. At this point, the needle supplies refill ink through the uncovered port and into the cartridge.

According to the invention, a first embodiment barrier comprises a plug. The plug comprises a post extending into the port. A flange surrounds the post and is integrally attached thereto for covering the port. As the needle is received through the slit of the septum during the refilling process, the needle will encounter and push the post. The plug, comprising the post and integrally attached flange, will then be expelled from the port and fall to the bottom of the cartridge cavity as the needle pushes the post. This allows the needle access to the cavity for refilling the cavity with ink.

According to a second embodiment barrier, the previously mentioned plug includes a flange that has an annular recessed portion therein of reduced strength. When the needle encounters the post during refilling of the cartridge, the post and the annular recessed portion of the flange separate from the plug to uncover the port. This again allows the needle access to the cavity for refilling the cavity with ink.

According to a third embodiment barrier, the previously mentioned plug comprises a hollow U-shaped portion extending into and covering the port. The U-shaped portion is capable of being pierced therethrough by the needle, as the needle encounters the U-shaped portion, to allow refilling of the cavity with ink.

According to a fourth embodiment barrier, the previously mentioned plug comprises a ball sized to be sealingly received in the port. When the needle encounters the ball during refilling of the cartridge, the ball is dislodged from the port for uncovering the port. This again allows the needle to refill the cavity with ink.

According to a fifth embodiment barrier, a flap has a first portion thereof affixed to the wall of the cartridge shell and a second portion thereof that is movable from a first position covering the port to a second position uncovering the port. A piston is connected to the second portion of the flap and extends into the port. The piston is capable of being pushed by the needle during the refilling process, so that the piston moves as the needle pushes the piston. As the needle pushes the piston, the second portion of the flap moves to the second position thereof to uncover the port.

A feature of the present invention is the provision of a barrier interposed between the cavity and the septum for isolating the cavity from the septum.

An advantage of the present invention is that use thereof prevents formation of zinc stearate crystals in the ink ejection orifices.

Another advantage of the present invention is that risk of image artifacts on a recording medium is reduced.

A further advantage of the present invention is that design freedom is increased when selecting a material for the septum.

These and other features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE PREFERRED EMBODIMENT

The present invention will be directed in particular to elements forming part of, or cooperating more directly with, apparatus in accordance with the present invention. It is to be understood that elements not specifically shown or described may take various forms well known to those skilled in the art.

Figure 1:
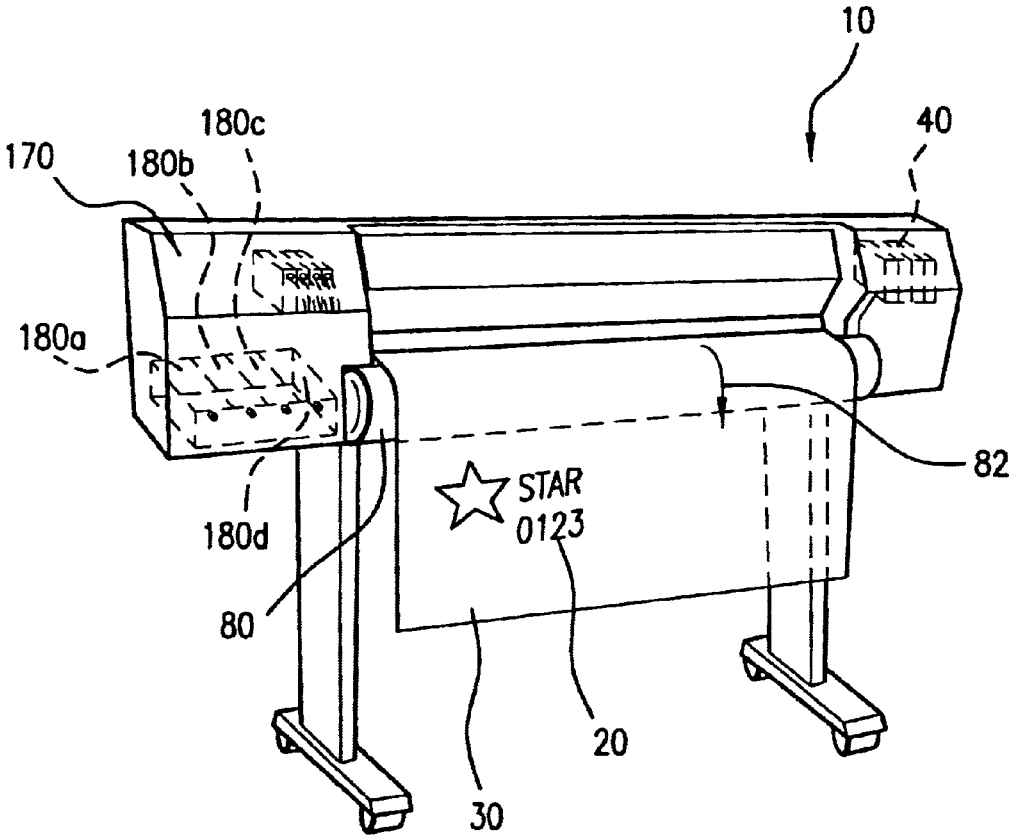
FIG. 1 is a view in perspective of an inkjet printer having a plurality of ink cartridges disposed therein.

Therefore, referring to FIG. 1, there is shown a thermal inkjet printer, generally referred to as 10, for printing an image 20 on a recording medium 30. The recording medium 30 may be a reflective recording medium, such as paper, textile, or the like or recording medium 30 may be a transmissive recording medium such as transparency.

Figure 2:
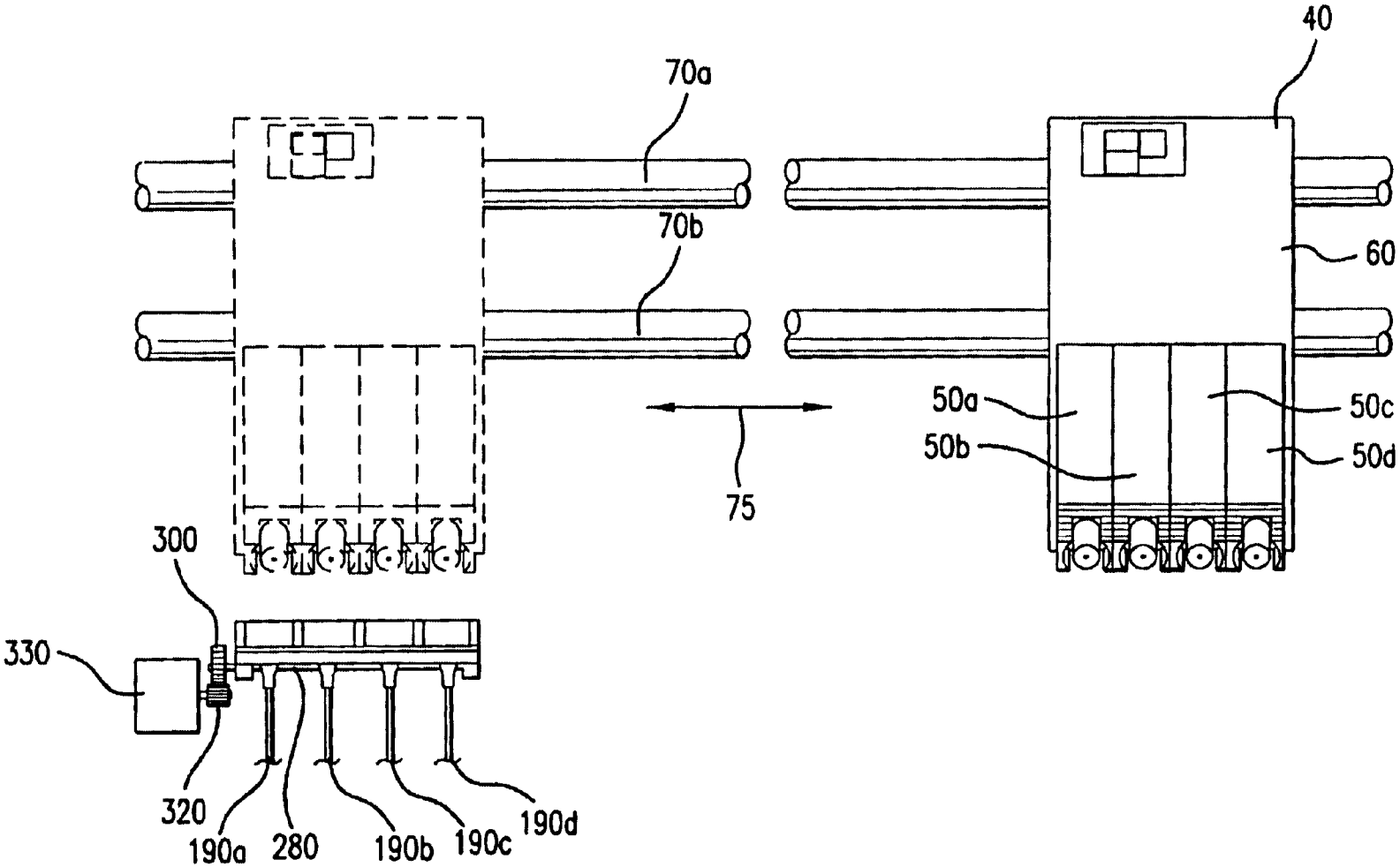
FIG. 2 is a plan view of a movable carriage, belonging to the printer, for carrying the cartridges.

Referring to FIGS. 1 and 2, printer 10 comprises a thermal inkjet pen assembly 40. Pen assembly 40 includes a plurality of adjacent ink cartridges 50*a*, 50*b*, 50*c* and 50*d* containing ink preferably having colors cyan, magenta, yellow and black, respectively. Although four ink cartridges 50*a*, 50*b*, 50*c* and 50*d* are disclosed herein, it should be appreciated that more or fewer ink cartridges may be present and different color inks may be used depending on the specific printing application required. Cartridges 50*a/b/c/d* are cradled in a carriage 60 slidably mounted on a plurality of parallel rails 70*a* and 70*b* extending at least the width of recording medium 30. Rails 70*a/b* allow carriage 60 to reciprocatingly traverse rails 70*a/b* in direction of double-headed arrow 75. Carriage 60 traverses rails 70*a/b* preferably by means of a belt and pulley assembly (not shown). Alternatively, carriage 60 may be driven by a motor (not shown) connected to carriage 60 and engaging at least one of rails 70*a/b*, if desired. A support member, such as a platen 80, is spaced-apart from and disposed opposite to carriage 60 for supporting recording medium 30. Platen 80 may be configured as an elongate cylindrical roller operable by a motor (not shown) for rotating platen 80, so that recording medium 30 moves in direction of an arrow 82.

Referring again to FIGS. 1 and 2, it may be understood that carriage 60, which carries ink cartridges 50*a/b/c/d*, is caused to traverse rails 70*a/b* in a first printing direction to print a first one of a plurality of printing swaths that will form image 20. As the first printing swath is printed, platen 80 is not rotated so that platen 80 remains stationary. Then, after the first swath is printed, platen 80 is rotated through a predetermined angle to advance recording medium 30 a predetermined distance in direction of an arrow 82. At that point, carriage 60 is caused to traverse rails 70*a/b* in a second printing direction opposite the first printing direction to print a second one of the printing swaths. In other words, carriage 60 reciprocatingly traverses rails 70*a/b* in direction of arrow 75. Platen 80 is rotated only after carriage 60 reaches end portions of rails 70*a/b* during each reciprocating motion of carriage 60. This process of reciprocating carriage 60 and rotating platen 80 is repeated until all printing swaths are printed and recording medium 30 receives the entire image 20. Of course, as carriage 60 traverses rails 70*a/b*, cartridges 50*a/b/c/d* are selectively operated to apply ink to recording medium 30. The structure of cartridges 50*a/b/c/d* is disclosed in detail hereinbelow.

Figure 3:
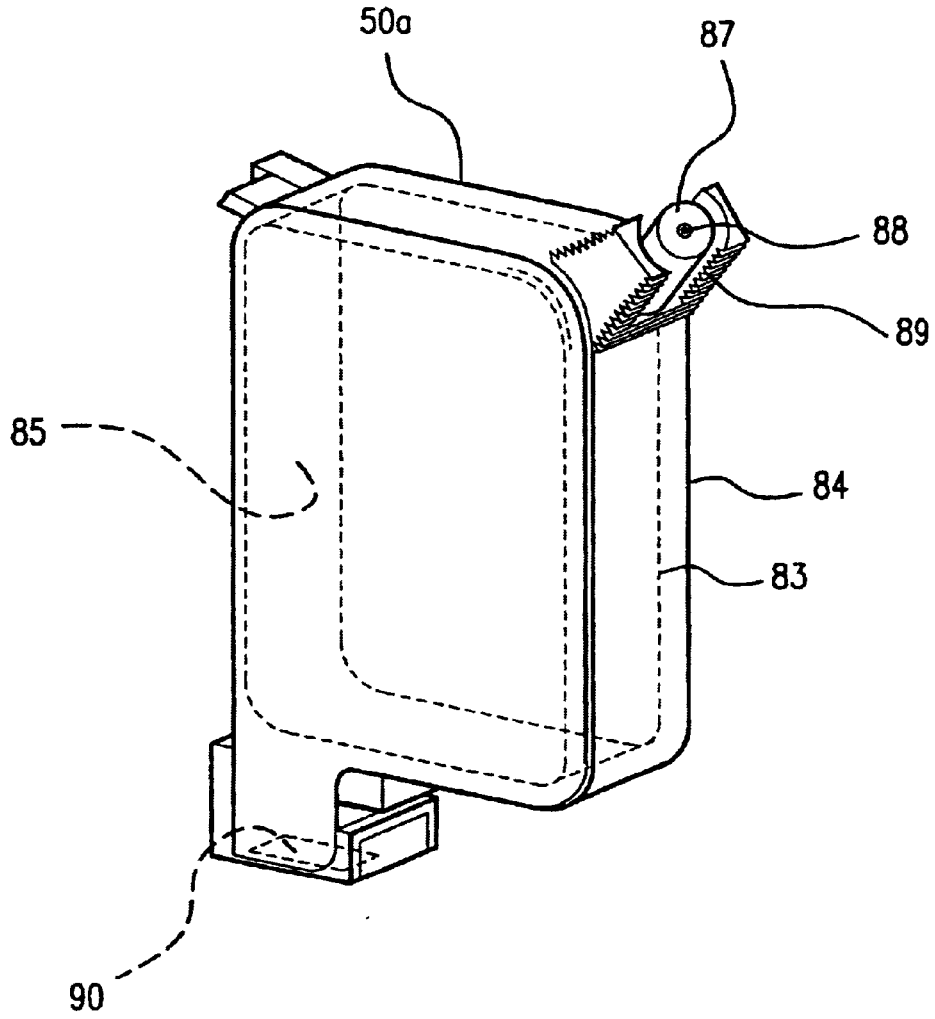
FIG. 3 is a view in perspective of an exemplary one of the cartridges, the cartridge defining a chamber therein shown in phantom and a septum sealing the chamber.
Figure 4:
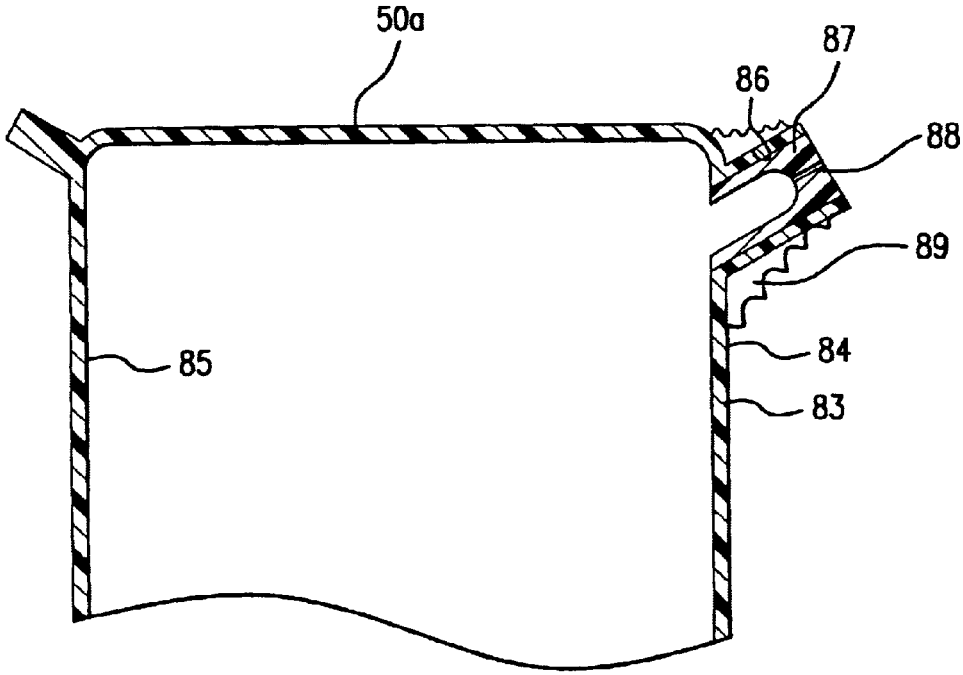
FIG. 4 is a fragmentary view in vertical section of the cartridge.

Referring to FIGS. 3 and 4, each ink cartridge 50*a*/*b*/*c*/*d* includes a shell 83 formed by a wall 84 defining an interior cavity 85 in shell 83 for storing ink. Composition of shell 83 may be plastic, such as the material marketed under the trademark "NORYL" by the General Electric Company, for resisting corrosive attack by the ink in cavity 85. Alternatively, composition of shell 83 may be a homopolymer of dimethyl 2,6-naphthalenedicarboxylate and ethylene glycol for resisting corrosive attack by the ink in cavity 85. Wall 84 also defines a generally cylindrical inlet port 86 through wall 84 for allowing access to cavity 85. Matingly disposed in port 86 is an elastomeric and generally cylindrical seal or septum 87. The septum 87 has a first surface and a second surface opposite the first surface. Septum 87 also has a longitudinal slit 88 centrally disposed therethrough and extending from the first surface to the second surface for reasons disclosed hereinbelow. The composition of septum 87 may comprise silicone rubber with zinc oxide and stearic acid as additives. Moreover, integrally attached to an external surface of wall 84 and partially surrounding port 86 is a grip structure 89 for manually gripping cartridges 50*a*/*b*/*c*/*d* during insertion and removal of cartridges 50*a*/*b*/*c*/*d* into and out of carriage 60.

Figure 5:
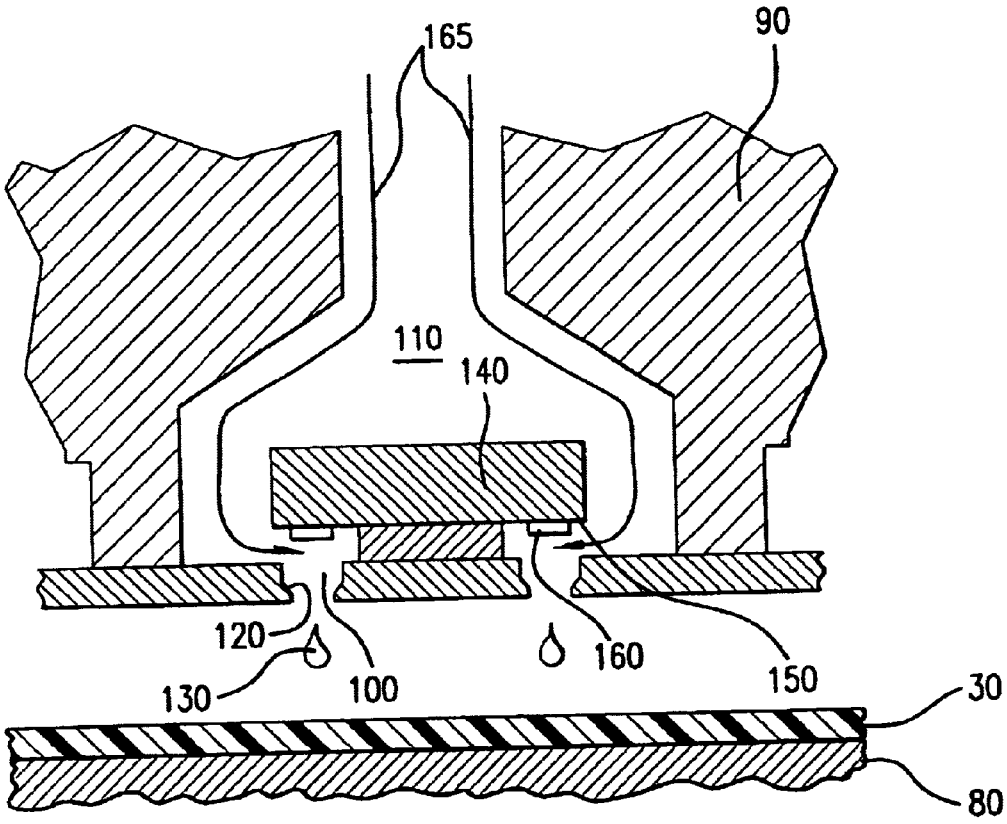
FIG. 5 is a fragmentary view in vertical section of an inkjet print head disposed in the chamber defined by the cartridge.
Figure 6:
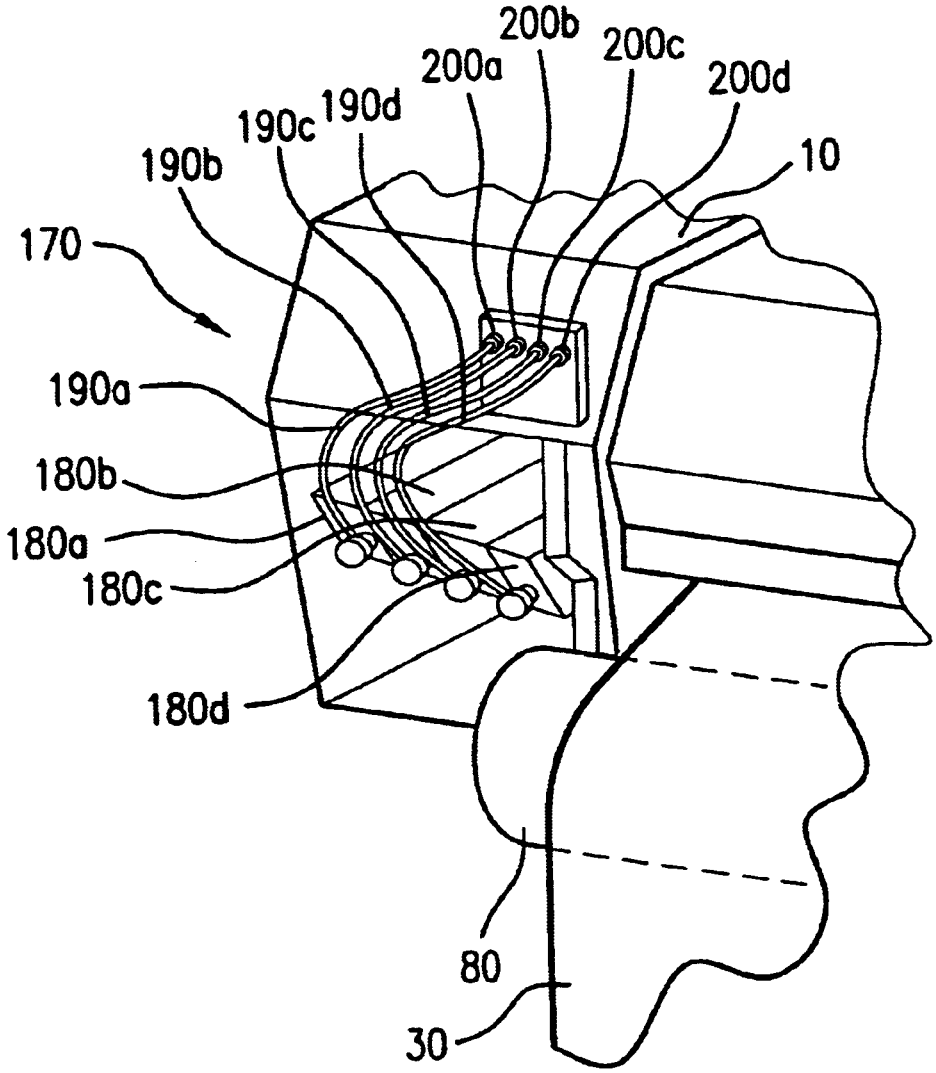
FIG. 6 is a fragmentary view in perspective of the printer, this view showing hoses leading from a plurality of ink supply reservoirs to respective ones of a plurality of needle valve assemblies configured for refilling the cartridges with ink.

Referring to FIGS. 3 and 5, disposed in cavity 85 is a print head 90. Formed in print head 90 is at least one ink ejection chamber 100, the chamber 100 being in fluid communication with an ink body 110. Ink ejection chamber 100 terminates in a plurality of ink ejection orifices 120 (only two of which are shown) for ejecting a plurality of ink drops 130 onto recording medium 30 in order to form image 20 on recording medium 30. Disposed in chamber 100 is a generally rectangular die 140. Die 140 has an underside surface 150 for reasons disclosed presently. In this regard, attached to underside surface 150 of die 140 is a plurality of thermal resistive heater elements or thin-film resistors 160 aligned with respective ones of orifices 120, for locally boiling ink body 110 in the vicinity of orifices 120. Resistors 160 are each electrically connected to a controller (not shown), so that the controller selectively controls flow of electrical energy to resistors 160 in response to output signals received from an image source, such as a scanner, computer or digital camera (all not shown). In this regard, when electrical energy momentarily flows to selected ones of resistors 160, the resistor 160 activates to locally heat ink body 110 thereby causing a vapor bubble (not shown) to form adjacent to resistor 160. The vapor bubble pressurizes chamber 100 by displacing ink body 110 in the vicinity of orifice 120 in order to squeeze ink drop 130 from ink body 110. Ink drop 130 travels through orifice 120 to be intercepted by recording medium 30. After a predetermined time, the controller ceases supplying electrical energy to resistor 160. The vapor bubble will thereafter collapse due to absence of energy input to ink body 110 and ink body 110 will subsequently refill chamber 100 generally along flow lines illustrated by dual arrows 165. Thermal print head 90 may preferably be of a type such as disclosed by U.S. Pat. No. 6,231,168 titled "Ink Jet Print Head With Flow Control Manifold Shape" issued May 15, 2001 in the name of Robert C. Maze and assigned to the assignee of the present invention, the disclosure of which is hereby incorporated by reference. Of course, after repeated activation of resistors 160, cartridges 50*a*/*b*/*c*/*d* will empty and become depleted of ink.

Figure 8:
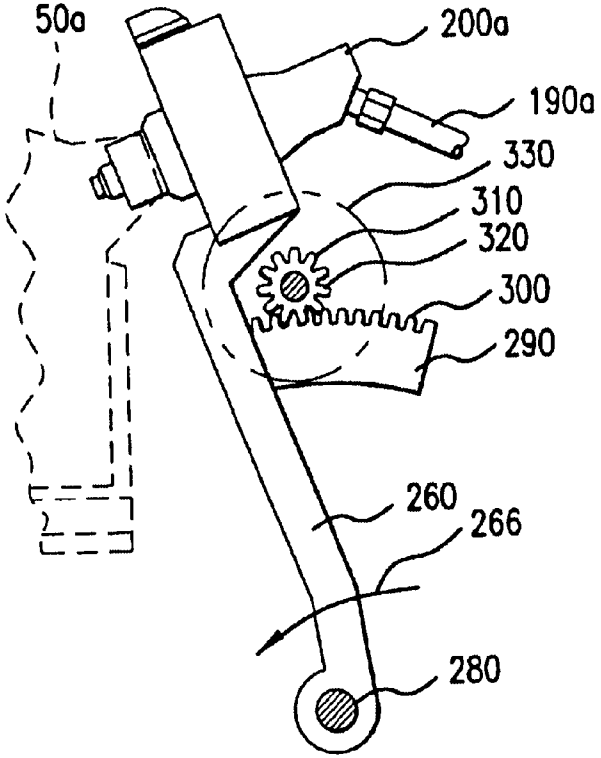
FIG. 8 is a view in elevation of the needle valve assembly engaging the depleted one of the cartridges.
Figure 9:
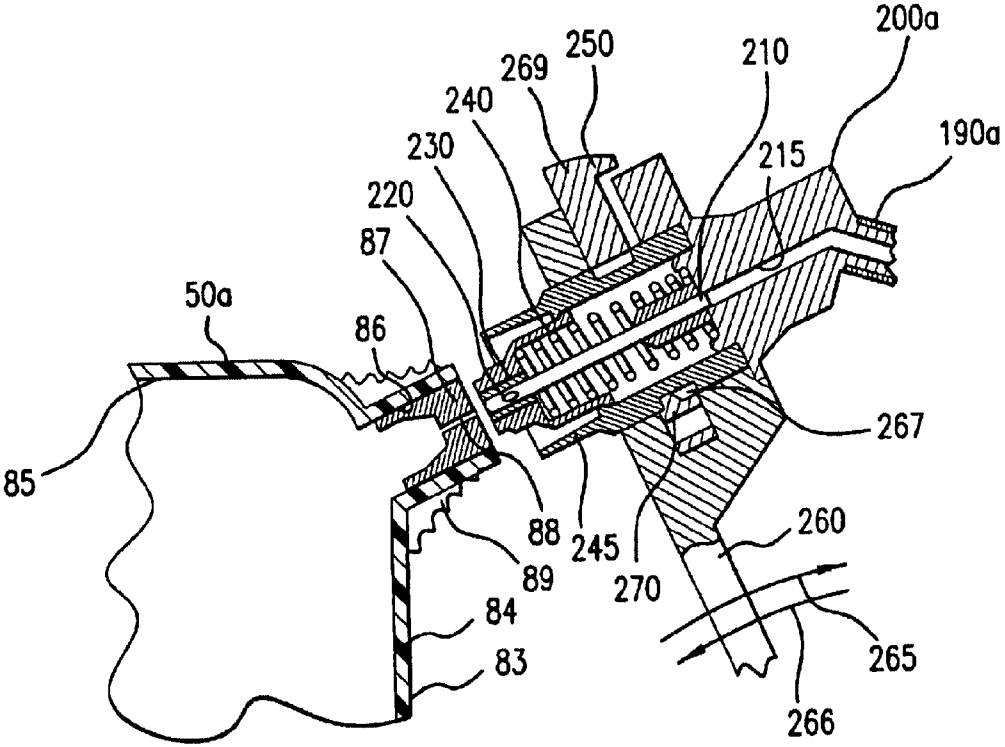
FIG. 9 is a view in partial vertical section of the needle valve assembly poised for engagement with the depleted one of the cartridges.

Referring to FIGS. 1, 2, 6, 7, 8 and 9, an ink refill station, generally referred to as 170, is provided for supplying ink to refill cavities 85 of all cartridges 50*a*/*b*/*c*/*d* after ink volume in any one of cartridges 50*a*/*b*/*c*/*d* drops below a predetermined threshold level. Refill station 170 has a plurality of replaceable ink reservoirs 180*a*, 180*b*, 180*c* and 180*d* containing ink of colors cyan, magenta, yellow and black, respectively. Each of reservoirs 180*a*/*b*/*c*/*d* is connected, such as by means of flexible hoses 190*a*/*b*/*c*/*d*, to respective ones of a plurality of needle valve assemblies 200*a*/*b*/*c*/*d*. As described more fully hereinbelow, needle valve assemblies 200*a*/*b*/*c*/*d* are connectable to respective ones of cartridges 50*a*/*b*/*c*/*d* for refilling cavities 85 in cartridges 50*a*/*b*/*c*/*d* with ink from reservoirs 180*a*/*b*/*c*/*d*. The description hereinbelow will be made with reference to a single needle valve assembly 200*a*; however, it may be appreciated that the description hereinbelow applies to all needle valve assemblies 200*a*/*b*/*c*/*d* as well. Valve assembly 200*a* comprises a hollow ink supply needle 210 having a plurality of openings 220 (only one of which is shown) formed therein adjacent to a distal end of needle 210. A proximal end of hollow needle 210 is disposed in a canal 215 formed in valve assembly 200*a*. Canal 215 is in turn coupled to hose 190*a*. In an initial state, a humidor or valve collar 230, which snugly surrounds needle 210, is biased by a spring 240 to a valve closed position (as best seen in FIG. 9), which spring 240 is disposed in a valve body 245. To accomplish this result, collar 230 is slidably disposed in valve body 245 and abuts an end portion of spring 240. However, when needle valve assembly 200*a* is forced against port 86 of cartridge 50*a*, collar 230 is pressed against spring 240 and up the length of needle 210, thereby allowing the distal end of needle 210 to open and slide through slit 88 of septum 87. Valve assembly 200*a* is now in a valve-open position. Ink can then flow from ink reservoir 180*a*, through hose 190*a*, into canal 215, through needle 210, out openings 220 and into cavity 85 for refilling cavity 85 with ink. When valve assembly 200*a* is pulled away from port 86, spring 240 biases collar 230 due to the elasticity of spring 240, so that valve assembly 200*a* returns to the valve-closed position. As valve assembly 200*a* returns to the valve-closed position, needle 210 will slide out slit 88 and slit 88 will automatically close due to elasticity of septum 87.

As best seen in FIG. 9, a resilient locking structure 250 releasably locks valve assembly 200*a* to an arm 260 that is movable in direction of arrows 265 and 266. Valve assembly 200*a*, which is locked to arm 260 at a socket 267, includes a handle 269 for reasons disclosed hereinbelow. In this regard, locking structure 250 includes locking surface 270 that engages an exterior surface of valve body 245 at location of socket 267. In this manner, locking structure 250 is locked to arm 260. In order to unlock locking structure 250 from arm 260, resilient locking structure 250 is biased by depressing handle 269 in order to disengage locking surface 270 from the exterior surface of valve body 245. Valve assembly 200*a* may then be manually pulled from arm 260, so that locking surface 270 leaves socket 267. Such a locking structure 250 is more particularly described in U.S. Pat. No. 6,113,229 titled "Interchangeable Fluid Interconnect Attachment And Interface" issued Sept. 5, 2000, in the name of Max Stephen Gunther, et al., and assigned to the assignee of the present invention, the disclosure of which is hereby incorporated by reference.

Figure 7:
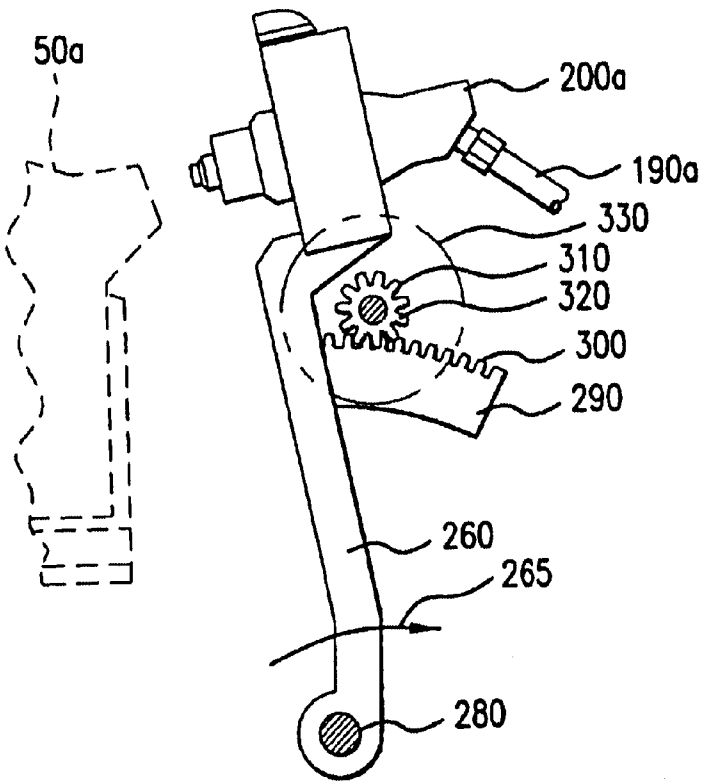
FIG. 7 is a view in elevation of one of the needle valve assemblies poised for engagement with a depleted one of the cartridges.

Referring to FIGS. 2, 7 and 8, the process of moving arms 260 during the refilling process will now be described. In this regard, each arm 260 is coupled to an elongate shaft 280 for supporting all arms 260. Although the description hereinbelow will be directed to a single arm 260, it should be appreciated that the description hereinbelow pertains to the plurality of arms 260 corresponding respective ones of valve assemblies 200*a*/*b*/*c*/*d*. Arm 260 is rotatable to-and-fro about shaft 280 in directions of arrows 265 and 266. Attached to arm 260 is a curvilinear lever 290 having a multiplicity of gear teeth 300 thereon. Gear teeth 300 matingly engage a multiplicity of sprocket teeth 310 formed in a sprocket 320. The sprocket 320 is itself coupled to a reversible stepper motor 330 for rotating sprocket 320 in clockwise or counter-clockwise directions (direction of arrow 265 and arrow 266, respectively). Motor 330 is coupled to the previously mentioned controller (not shown) for controlling operation of motor 330. Thus, when a low-ink state is detected in any one of cartridges 50*a/b/c/d* by the controller, carriage 60 is caused to move along rails 70*a/b* to ink refill station 170. Motor 330 will then rotate sprocket 320 such that sprocket teeth 310 engage gear teeth 300 to rotate arm 260 in direction of arrow 266 . At this point, valve assembly 200*a* engages port 86. Although all arms 260 and all valve assemblies 200*a/b/c/d* move as a unit, the description herein will be directed to valve assembly 200*a*, it being understood that the description herein applies to all valve assemblies 200*a/b/c/d*. When valve assembly 200*a* engages port 86, needle 210 will pass through slit 88 of septum 87 and ink will flow from ink reservoirs 180*a/b/c/d*, along canal 215, through openings 220 in needle 210, and into cavity 85. The ink will flow from ink reservoirs 180*a/b/c/d* due to the slight negative pressure (i.e., back pressure) present in cartridges 50*a/b/c/d*. This back pressure, which may initially be between approximately—1.0 and approximately—7.0 inches of water, will decrease as more ink is introduced into cavity 85. Therefore, a time is reached after which there will be insufficient back pressure to pull ink into cavity 85. At that time, cartridges 50*a/b/c/d* are considered refilled and motor 330 is again operated so that arm 260 rotates in direction of arrow 265 in order to disengage valve assembly 200*a* from port 86.

Figure 10:
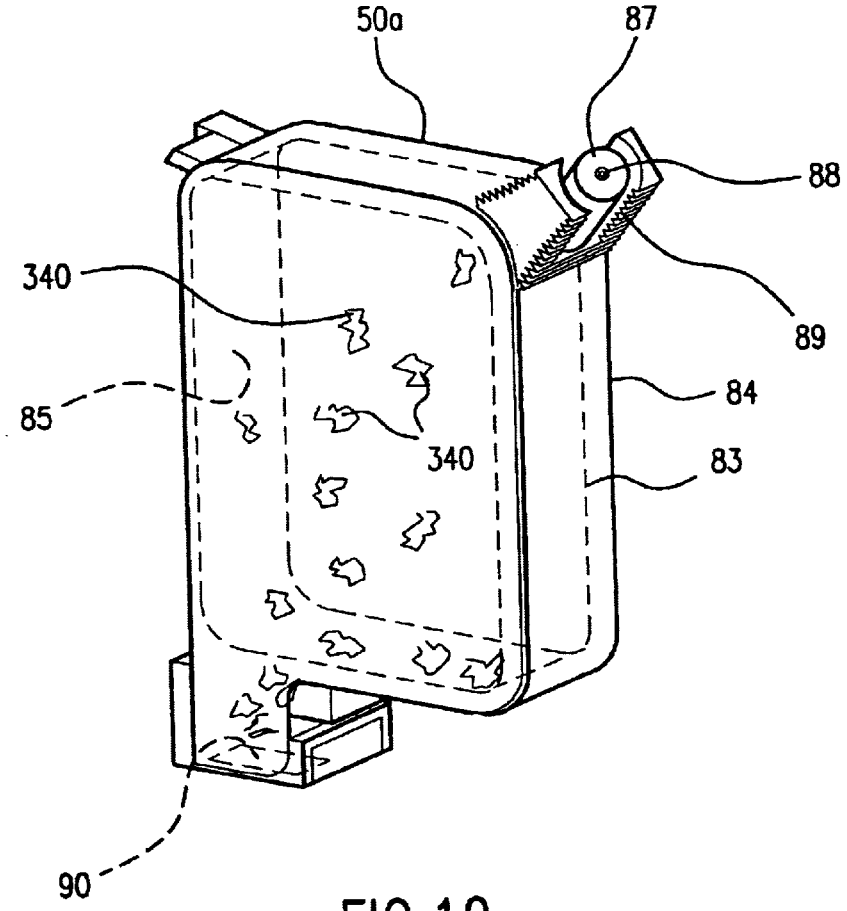
FIG. 10 is a view in perspective of the cartridge prior to insertion into the carriage, this view also showing zinc stearate crystals forming in the chamber and migrating from the septum and toward the ink ejection print head disposed in the chamber.
Figure 11:
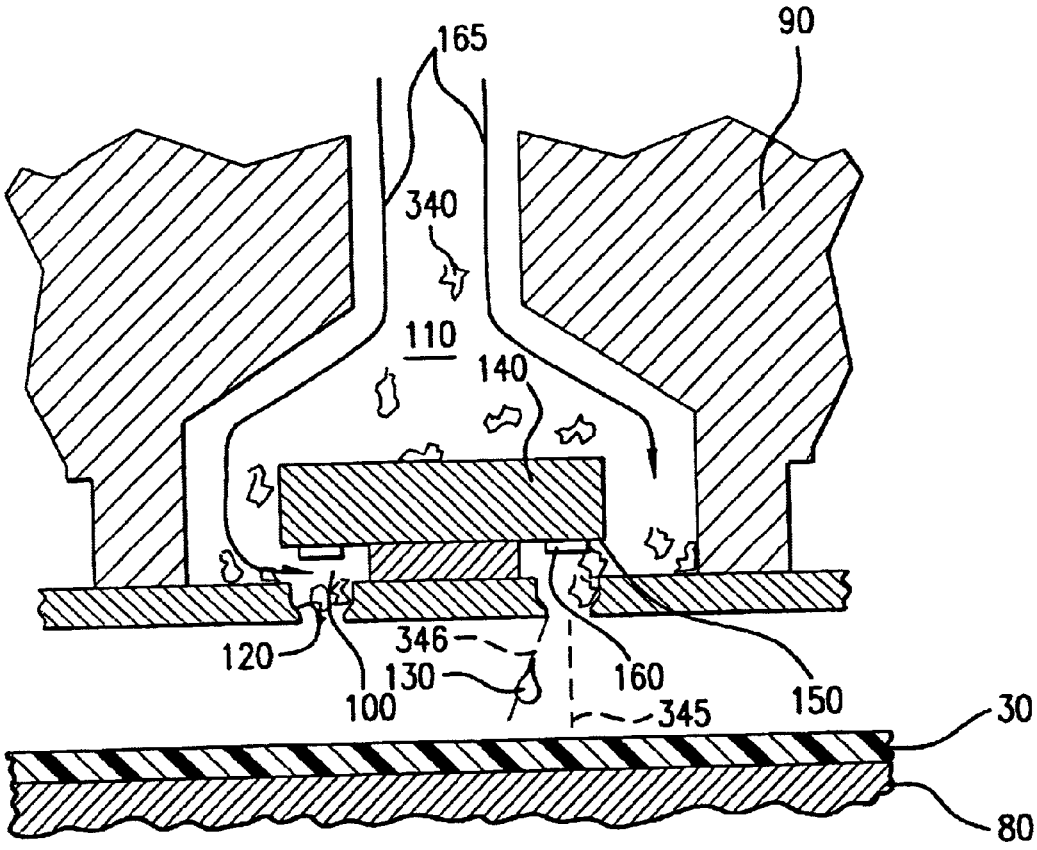
FIG. 11 is a fragmentary view in elevation of the print head, this view showing the crystals accumulating in a plurality of ink ejection orifices formed in the print head.

However, as seen in FIGS. 10 and 11, during prolonged shipment and storage of a newly manufactured ink cartridge, such as cartridges 50*a/b/c/d*, the ink in cavity 85 may chemically interact with the zinc oxide and stearic acid constituents of septum 87. Over time, the ink leaches the zinc oxide and stearic acid from septum 87 to form a multiplicity of zinc stearate crystals 340 in the ink in cavity 85. The chemical reaction believed responsible for formation of the zinc stearate is as follows:

$$ZnO+2(C_{18}H_{36}O_2)\rightarrow Zn(C_{18}H_{35}O_2)_2+H_2O$$

where, ZnO is zinc oxide;

$C_{18}H_{36}O_2$ is stearic acid;

$Zn(C_{18}H_{35}O_2)_2$ is zinc stearate; and $H_2O$ is water.

Referring again to FIGS. 10 and 11, these zinc stearate crystals 340 may then migrate to ink ejection orifices 120 and accumulate thereat to either partially or completely block orifices 120. However, the precise mechanism by which the zinc stearate crystals 340 form is not completely understood. In this regard, zinc stearate may instead remain in solution (i.e., dissolved) in the ink in cavity 85 and only form crystals when interacting with an adhesive tape 342 covering orifices. As a step in manufacture of the cartridge, adhesive tape 342 is placed over ink ejection orifices 120 to prevent ink weeping or leaking from orifices 120 during packaging and shipment of the newly manufactured cartridge. The composition of adhesive tape 342 exposed to the ink in orifices 120 may comprise zinc stearate as a constituent. Interaction of the ink with the zinc stearate composition of tape 342, which is manually removed by the user prior to insertion of cartridges 50*a/b/c/d* into carriage 60, may contribute to formation of crystals 340 at orifices 120. However, it is believed that the primary contribution of zinc stearate crystals 340 is from chemical interaction between the ink and septum 87. In any event, accumulation of zinc stearate crystals 340 at orifices 120 will tend to completely or partially block orifices 120. It is undesirable to block orifices 120 because blocking orifices 120 interferes with proper ejection of ink drops 130 during printing. Even when crystals 340 only partially block orifices 120, trajectory of ejected ink drop 130 will deviate from its normal trajectory 345 to travel along a deviated trajectory 346 and strike recording medium 30 at an unintended location. Blocking orifices 120 and travel of ink drop 130 along deviated trajectory 346 will produce image artifacts on recording medium 30. Such image artifacts may appear, for example, as "banding" and errant ink dots. For all the foregoing reasons, it is desirable to avoid chemical interaction between the ink and septum 87 during shipment and prolonged storage of cartridges 50*a/b/c/d*.

As previously mentioned, septum 87 comprises zinc oxide and stearic acid that might otherwise leach-out of septum 87 to form zinc stearate. However, it may be appreciated that septum 87 may comprise constituents other than zinc oxide and stearic acid. In that case, crystals that are formed may be other than zinc stearate crystals. In other words, use of the invention is not limited to those instances when septum 87 comprises zinc oxide and stearic acid; rather, the invention is useable whenever it is desired to isolate septum 87 from the ink.

Figure 12:
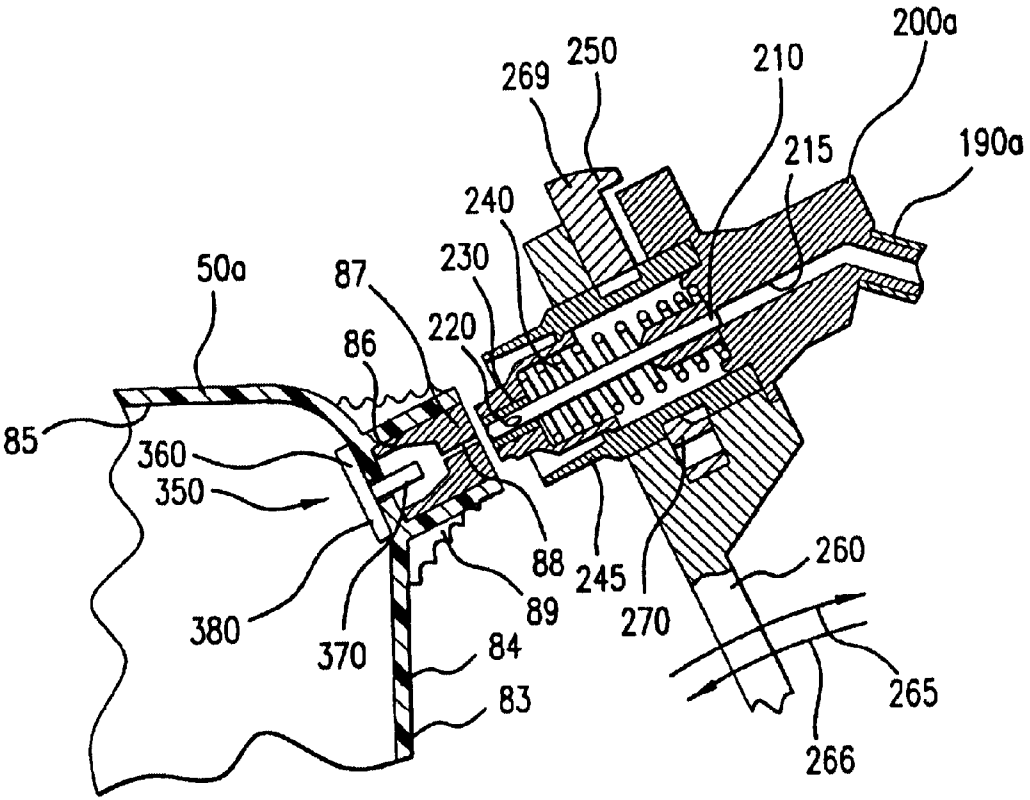
FIG. 12 is a fragmentary view in vertical section of the depleted cartridge, this view showing a first embodiment barrier isolating the chamber from the septum and also showing an ink supply needle belonging to the needle valve assembly before the needle valve assembly engages the depleted cartridge.

Therefore, turning now to FIG. 12, there is shown cartridge 50*a* comprising a removable first embodiment barrier, generally referred to as 350, for isolating ink in cavity 85 from septum 87 in order to avoid chemical interaction between the ink and septum 87. Avoiding chemical interaction between the ink and septum 87 reduces risk of formation of zinc stearate crystals 340. Reduced risk of formation of crystals 340 provides reliable operation of print head 90, as previously mentioned. Although barrier 350 is shown disposed in only one cartridge 50*a*, it will be understood that barrier 350 is also disposed in each cartridge 50*a/b/c/d*. Barrier 350 comprises a plug 360, which may be stainless steel, plastic, or other material unaffected by ink or which does not itself affect the ink. Plug 360 is sealingly centrally disposed in port 86 at time of manufacture of cartridge 50*a*. Moreover, plug 360 comprises a cylindrical post 370 extending a predetermined distance into port 86 and a flange 380 extending around post 370. Flange 380 is sized to surround and cover port 86 while plug 360 is disposed in port 86. In this manner, flange 380 annularly seals port 86. As previously mentioned, ink in cavity 85 of cartridge 50*a* is depleted during operation of printer 10. Therefore, the controller senses this state of low ink level and moves carriage 60 to ink refill station 170, so that all cartridges 50*a/b/c/d* may be refilled with ink from respective ones of ink reservoirs 180*a/b/c/d*. However, in order to refill cartridges 50*a/b/c/d* with ink, plug 360 has to be removed. A technique for removal of first embodiment plug 360 is described in detail hereinbelow.

Therefore, turning now to FIG. 12, there is shown cartridge 50*a* comprising a removable first embodiment barrier, generally referred to as 350, for Isolating ink in cavity 85 from septum 87 in order to avoid chemical Interaction between the ink and septum 87. Avoiding chemical interaction between the Ink and septum 87 reduces risk of formation of zinc stearate crystals 340. Reduced risk of formation of crystals 340 provides reliable operation of print head 90, as previously mentioned. A,though barrier 350 Is shown disposed in only cartridge 50*a*, it will be understood that barrier 350 Is also disposed in each cartridge 50*a/b/c/d*. Barrier 350 comprises a plug 360, which may be stainless steel, plastic, or other material unaffected by ink or which does not itself affect the ink. Plug 360 is sealingly centrally disposed in port 86 at time of manufacture of cartridge 509a Moreover, plug 360 comprises a cylindrical post 370 extending a predetermined distance into port 86 and a flange 380 extending around post 370. Flange 380 is sized to surround and cover port 86 while plug 360 is disposed in port 86. In this manner, flange 380 annularly seals port 86. As previously mentioned, ink in cavity 85 of cartridge 50*a* is depleted during operation of printer 10. Therefore, the controller senses this state of low Ink level and moves carriage 60 to Ink refill station 170, so that all cartridges 50*a/b/c/d* may be refilled with ink from respective ones of ink reservoirs 180*a/b/c/d*. However, in order to refill cartridges 50*a/b/c/d*. with ink, plug 360 has to be removed. A technique for removal of first embodiment plug 360 is described in detail hereinbelow.

Figure 14:
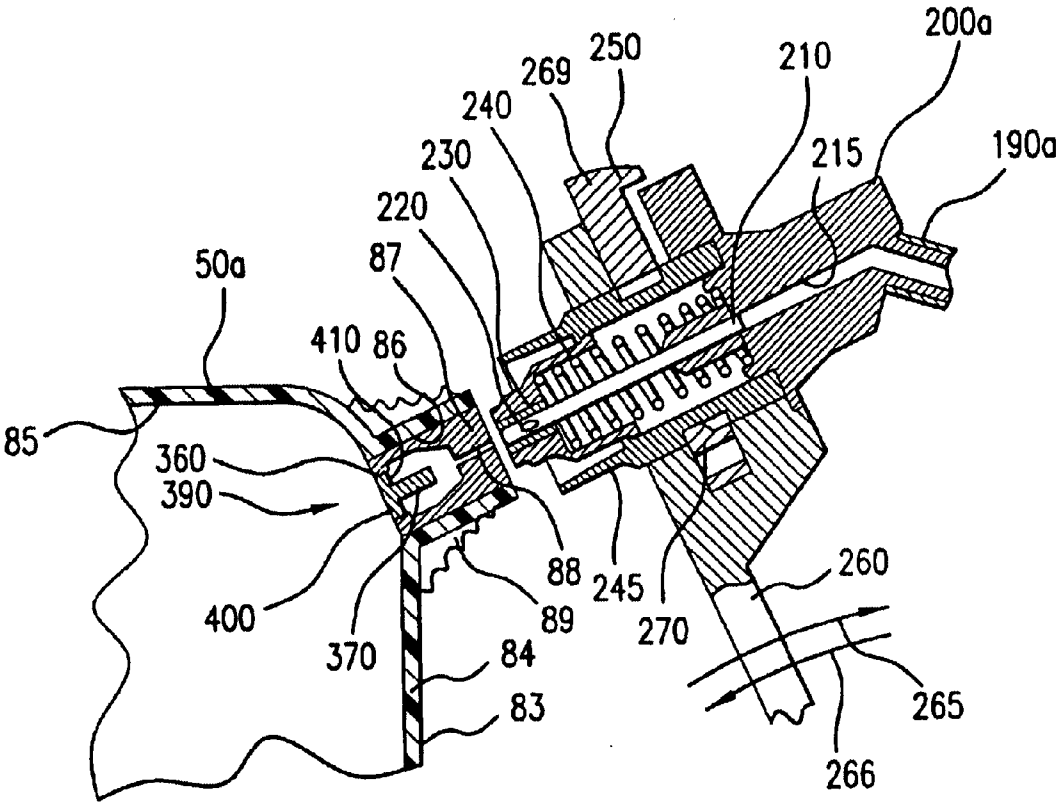
FIG. 14 is a fragmentary view in vertical section of the depleted cartridge, this view showing a second embodiment barrier isolating the chamber from the septum and also showing the ink supply needle belonging to the needle valve assembly before the needle valve assembly engages the depleted cartridge.
Figure 15:
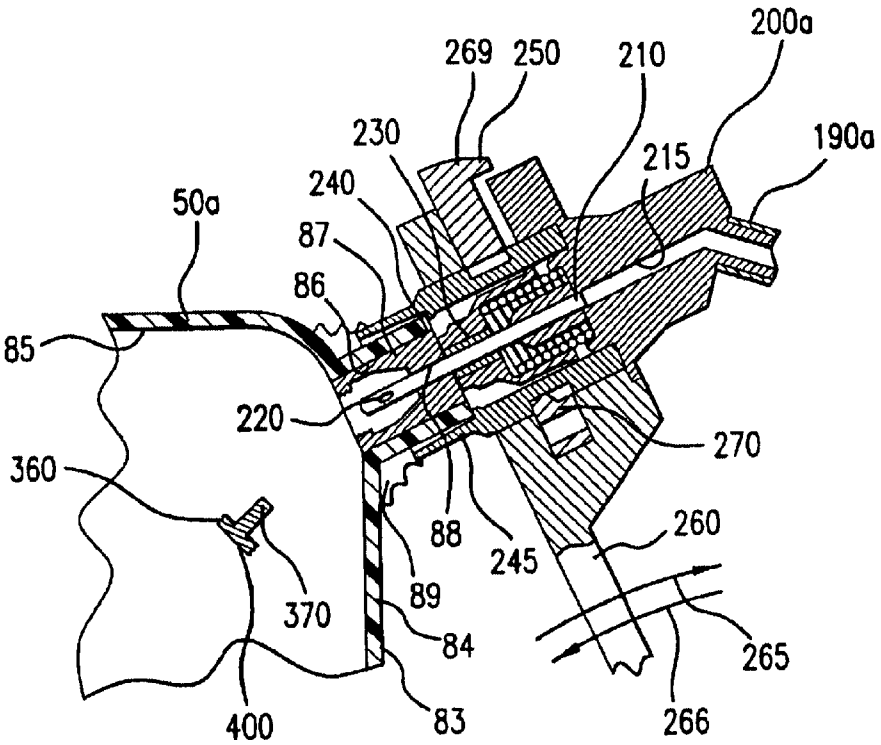
FIG. 15 is a fragmentary view in vertical section of the depleted cartridge, this view showing the second embodiment barrier being broken by the needle as the needle valve assembly engages the depleted cartridge.

Referring to FIGS. 14 and 15, there is shown cartridge 50*a* comprising a removable second embodiment barrier, generally referred to as 390, for isolating ink in cavity 85 from septum 87 in order to avoid chemical interaction between the ink and septum 87. Barrier 390 comprises the previously mentioned plug 360 preferably integrally molded with wall 84. Plug 360 includes post 370, which extends into port 86. A flange 400 extends around post 360 and is sized to cover port 86 while plug 360 is disposed in port 86. However, second embodiment barrier 390 differs from first embodiment barrier 350 in that flange 400 includes an annular recessed portion 410 therein for reasons disclosed presently. In this regard, recessed portion 410 of flange 400 possesses reduced strength compared to the remainder of flange 400 because less material is present at the recessed portion 410. Thus, when needle 210 pushes post 370 in the manner disclosed hereinabove, recessed portion 410 and post 370 will separate or break-away from flange 400 in the region of recessed portion 410. In this manner, port 86 is uncovered. Recessed portion 410 and post 370 will then fall to the bottom of cavity 85.

Figure 16:
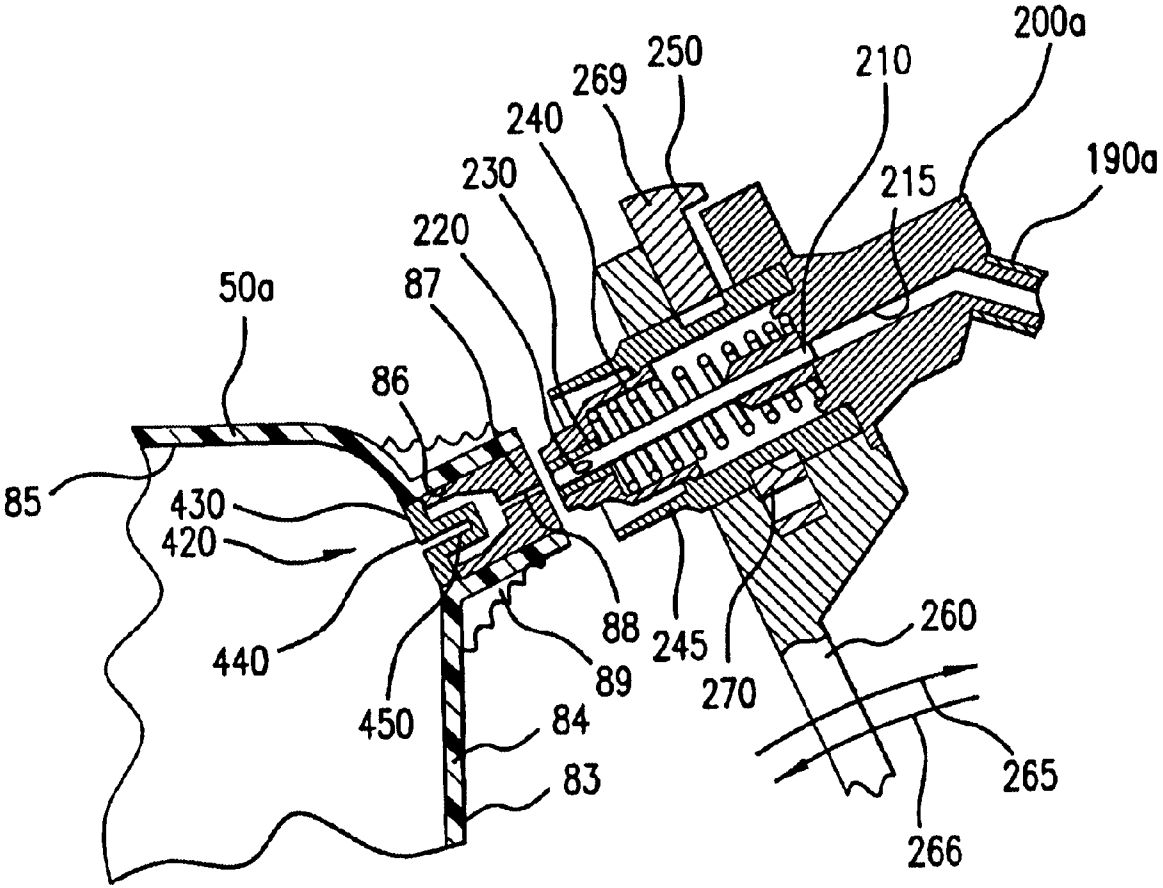
FIG. 16 is a fragmentary view in vertical section of the depleted cartridge, this view showing a third embodiment barrier isolating the chamber from the septum and also showing the ink supply needle belonging to the needle valve assembly before the needle valve assembly engages the depleted cartridge.
Figure 17:
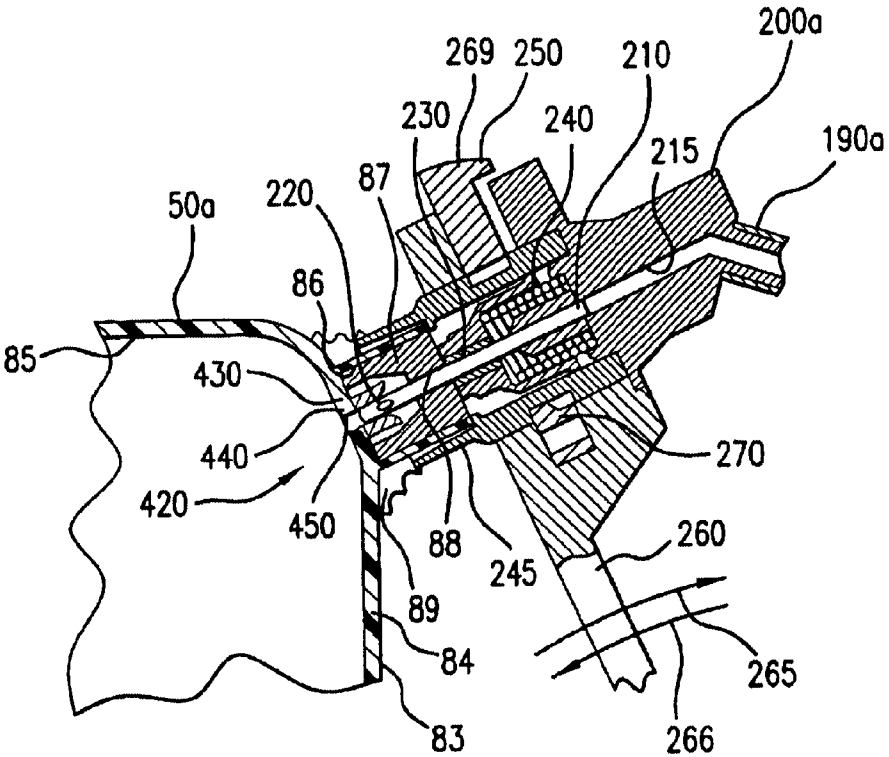
FIG. 17 is a fragmentary view in vertical section of the depleted cartridge, this view showing the third embodiment barrier being pierced by the needle as the needle valve assembly engages the depleted cartridge.

Referring to FIGS. 16 and 17, there is shown cartridge 50*a* comprising a third embodiment barrier, generally referred to as 420, for isolating ink in cavity 85 from septum 87 in order to avoid chemical interaction between the ink and septum 87. Barrier 420 comprises a plug member 430 preferably integrally molded with wall 84. Plug member 430 has a generally U-shaped (in transverse cross section) portion 440 extending into port 86. U-shaped portion 440 defines a hollow crevasse 450 in communication with cavity 85. Plug member 430 is relatively thin-walled, so that when needle 210 encounters U-shaped portion 440 during refilling of cartridge 50*a* in the manner disclosed hereinabove, needle 210 pierces U-shaped portion 440 and enters crevasse 450. At this point, ink is allowed to refill cavity 85.

Figure 18:
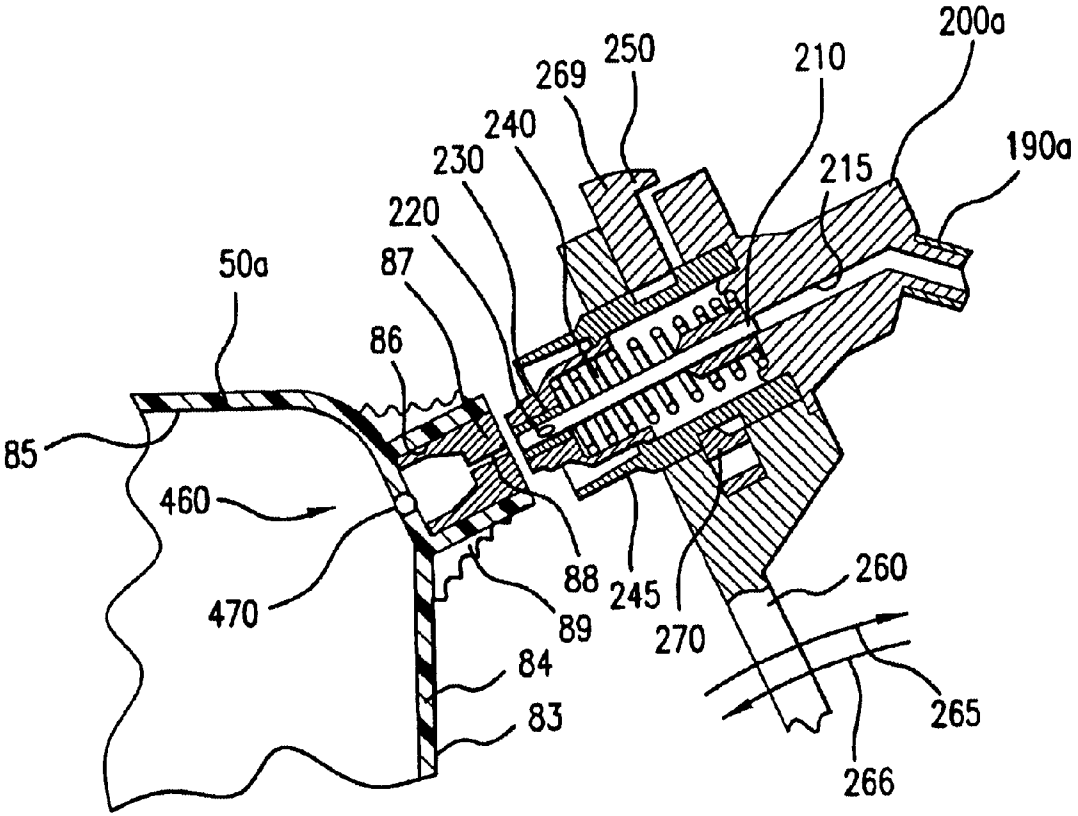
FIG. 18 is a fragmentary view in vertical section of the depleted cartridge, this view showing a fourth embodiment barrier isolating the chamber from the septum and also showing the ink supply needle belonging to the needle valve assembly before the needle valve assembly engages the depleted cartridge.
Figure 19:
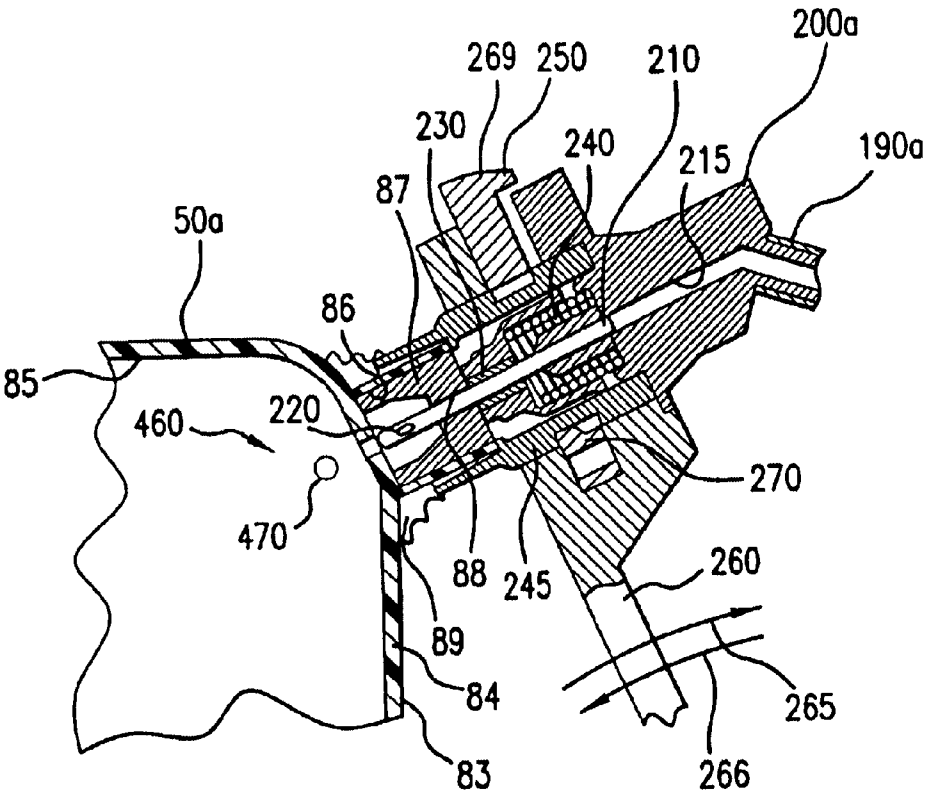
FIG. 19 is a fragmentary view in vertical section of the depleted cartridge, this view showing the fourth embodiment barrier being removed by the needle as the needle valve assembly engages the depleted cartridge.

Referring to FIGS. 18 and 19, there is shown cartridge 50*a* comprising a removable fourth embodiment barrier, generally referred to as 460, for isolating ink in cavity 85 from septum 87 in order to avoid chemical interaction between the ink and septum 87. Barrier 460 includes a plug member comprising a ball 470 sized to be sealingly received in port 86. Needle 210 will encounter ball 470 during refilling of cartridge 50*a* in the manner disclosed hereinabove. As needle 210 encounters ball 470, needle 210 will push ball 470 with sufficient force to expel ball 470 from port 86 in order to expose septum (and needle 210) to cavity 85. Ball 470, once dislodged from port 86, falls to the bottom of cavity 85.

Figure 20:
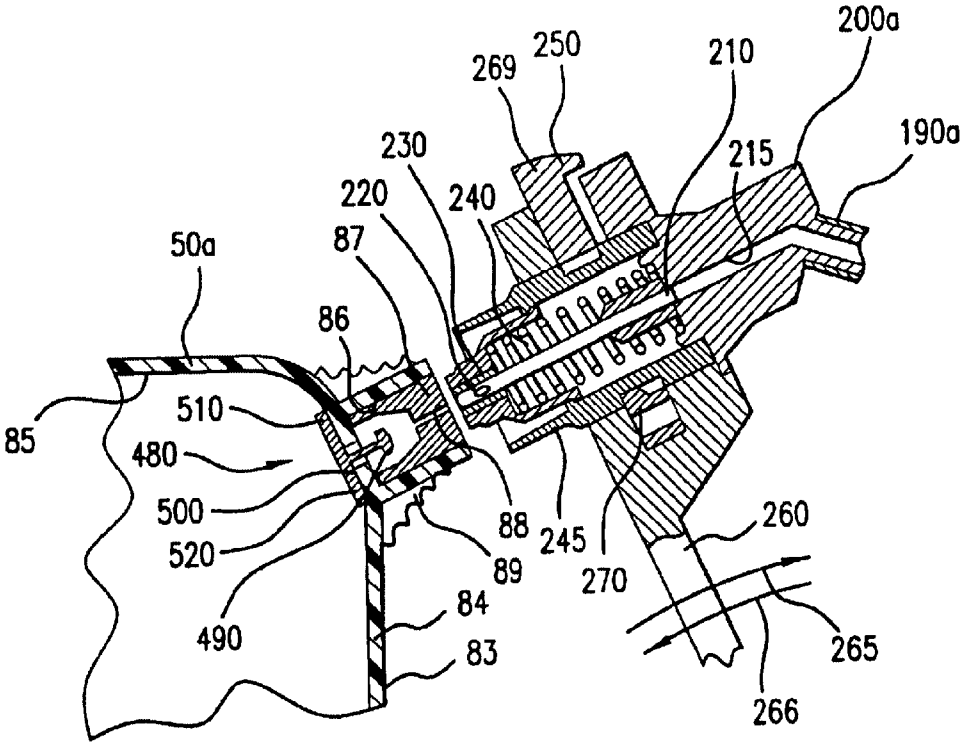
FIG. 20 is a fragmentary view in vertical section of the depleted cartridge, this view showing a fifth embodiment barrier isolating the chamber from the septum and also showing the ink supply needle belonging to the needle valve assembly before the needle valve assembly engages the depleted cartridge.
Figure 21:
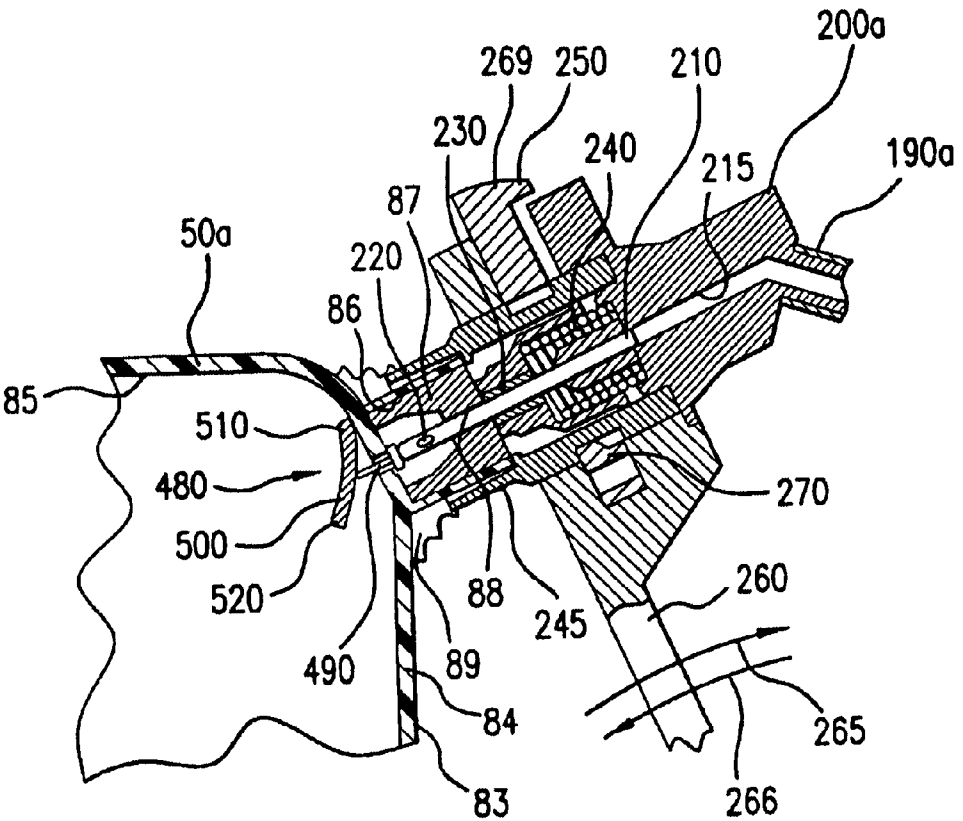
FIG. 21 is a fragmentary view in vertical section of the depleted cartridge, this view showing the fifth embodiment barrier being moved aside by the needle as the needle valve assembly engages the depleted cartridge.

Referring to FIGS. 20 and 21, there is shown cartridge 50*a* comprising a movable fifth embodiment barrier, generally referred to as 480, for isolating ink in cavity 85 from septum 87 in order to avoid chemical interaction between the ink and septum 87. Barrier 480 comprises a piston 490 extending into port 86. Attached to piston 490 is a flap 500 configured to cover port 86. Flap 500 has a first portion 510 thereof affixed to wall 84 of cartridge 50*a*. Flap 500 also has a second portion 520 not affixed to wall 84. Second portion 520 is movable from a first position covering port 86 while piston 490 is not pushed by needle 210 to a second position uncovering port 86 while piston 490 is pushed by needle 210. Piston 490 will be pushed by needle 210 during refilling of cartridge 50*a* in the manner disclosed hereinabove. Flap 500 may comprise a resilient material, such as thin stainless steel or flexible plastic, or even a "shape memory" alloy, such as an alloy of copper-zinc-aluminum, an alloy of copper-aluminum-nickel, or the like. In this manner, flap 500 returns to its initial position to again cover port 86 after refilling of cartridge 50*a* with ink. Recovering port 86 in this manner again isolates septum 87 from ink in cavity 85 even after the refilling operation.

Still referring to FIGS. 20 and 21, an alternative means may be used for moving second portion 520 of flap 500, if desired. In this regard, cavity 85 is under slight negative pressure after initial filling with ink. However, during refilling, pressure on the septum-side of flap 500 is greater than pressure on the cavity-side of flap 500. This pressure difference across flap 500 causes second portion 520 of flap 500 to move from the first position covering port 86 to the second position uncovering port 86. This alternative means for moving second portion 520 of flap 500 obviates need for needle 210 to move second portion 520.

While the invention has been described with particular reference to its preferred embodiments, it will be understood by those skilled in the art that various changes may be made and equivalents may be substituted for elements of the preferred embodiments without departing from the invention. For example, although the invention is disclosed herein in connection with ink cartridges for thermal inkjet printers, the invention may also be used in connection with ink cartridges for piezoelectric inkjet printers.

It may be appreciated from the description hereinabove that an advantage of the present invention is that use thereof prevents formation of zinc stearate crystals In the Ink ejection orifices. This Is so because the barrier, which Is Interposed between the cavity and the septum, prevents chemical interaction between the ink and the septum. That is, the barrier prevents Ink leaching zinc oxide and stearic acid from the septum, which zinc oxide and stearic acid would otherwise form zinc stearate crystals.

It may be appreciated from the description hereinabove that another advantage of the present invention is that use thereof reduces risk of detrimental image artifacts on a recording medium. This is so because appreciable amounts of zinc stearate crystals do not form and therefore do not migrate to the ink ejection orifices to block the orifices. Hence, the orifices remain relatively free of crystals for unimpeded ejection of ink drops. Such unimpeded ejection of ink drops prevents image artifacts.

It may be appreciated from the description hereinabove that a further advantage of the present invention is that use thereof increases design freedom in selecting a material for the septum. This is so because the barrier isolates the ink from the septum material.

Therefore, what is provided is an inkjet printer cartridge and method of assembling same, the printer cartridge being adapted to avoid chemical interaction between ink stored in the cartridge and a seal sealing the cartridge.

PARTS LIST

10 . . . inkjet printer
20 . . . image
30 . . . recording medium
40 . . . pen assembly
50*a/b/c/d* . . . ink cartridges
60 . . . carriage
70*a/b* . . . rails
75 . . . arrow (direction of carriage travel)
80 . . . platen
82 . . . arrow (direction of travel of recording medium)
83 . . . shell
84 . . . wall
85 . . . cavity
86 . . . inlet port
87 . . . seal/septum
88 . . . slit
89 . . . grip structure
90 . . . print head
100 . . . ink ejection chamber
110 . . . ink body
120 . . . ink ejection orifice
130 . . . ink drop
140 . . . die
150 . . . underside surface (of die)
160 . . . resistor
165 . . . arrow (ink flow paths after resistor firing)
170 . . . ink refill station
180*a/b/c/d* . . . ink reservoirs
190*a/b/c/d* . . . hoses
200*a/b/c/d* . . . needle valve assemblies
210 . . . needle
215 . . . canal
220 . . . openings
230 . . . valve collar
240 . . . spring
245 . . . valve body
250 . . . locking structure
260 . . . arm
265 . . . arrow (direction of reverse movement of arm)
266 . . . arrow (direction of forward movement of arm)
267 . . . socket
269 . . . handle
270 . . . locking surfaces
280 . . . shaft
290 . . . lever
300 . . . gear teeth
310 . . . sprocket teeth
320 . . . sprocket
330 . . . stepper motor
340 . . . crystals
342 . . . adhesive tape
345 . . . normal trajectory of ink drop
346 . . . deviated trajectory of ink drop
350 . . . first embodiment barrier
360 . . . plug
370 . . . post
380 . . . flange
390 . . . second embodiment barrier
400 . . . flange
410 . . . recessed portion of flange
420 . . . third embodiment barrier
430 . . . plug member
440 . . . U-shaped portion (of plug member)
450 . . . crevasse
460 . . . fourth embodiment barrier
470 . . . ball
480 . . . fifth embodiment barrier
490 . . . piston
500 . . . flap
510 . . . first portion (of flap)
520 . . . second portion (of flap)

What is claimed is:

1. A printer ink cartridge, comprising:

a. a shell defining a cavity therein for storing the ink and an inlet port allowing access to the cavity;

b. a seal spanning the port; and c. a barrier-interposed between the cavity and said seal for isolating the cavity from said seal to avoid chemical interaction between the ink and said seal, said barrier being permanently removable, as a needle pushes said barrier after the needle pierces said seal, from between the cavity and said seal so that said seal is in communication with the cavity.

2. The ink cartridge of claim 1, wherein said barrier comprises a plug disposed in the port.

3. The ink cartridge of claim 1, wherein said barrier comprises a flap covering the port.

4. A printer ink cartridge, comprising:

a. a shell defining a cavity therein for storing ink and an inlet port allowing access to the cavity;

b. a seal disposed in the port for sealing the port, said seal capable of being pierced therethrough by a needle; and c. a removable barrier interposed between the cavity and said seal and covering the port for isolating the cavity from said seal to avoid chemical interaction between the ink and said seal, whereby the needle pushes said barrier after the needle pierces said seal, whereby said barrier is permanently removed as the needle pushes said barrier and whereby said barrier uncovers the port as said barrier is removed.

5. The ink cartridge of claim 4, wherein said barrier comprises a plug sealingly disposed in the port.

6. The ink cartridge of claim 4, wherein said barrier comprises a flap having a first portion thereof affixed to said shell and a second portion thereof movable from a first position covering the port while said barrier is not pushed by the needle to a second position uncovering the port while said barrier is pushed by the needle.

7. A printer ink cartridge, comprising:

a. a shell formed by a wall defining a cavity in the shell for storing ink and defining an inlet port through the wall for allowing access to the cavity;

b. a septum matingly disposed in the port for sealing the port, said septum having a first surface and a second surface and a slit therethrough extending from the first surface to the second surface for sealably receiving an ink supply needle; and c. a removable barrier interposed between the cavity and the port and covering the port for isolating the ink in the cavity from said septum in order to avoid chemical interaction between the ink and said septum, whereby the needle pushes said barrier after the needle is received through the slit, whereby said barrier is permanently removed as the needle pushes said barrier and whereby said barrier uncovers the port as said barrier is removed.

8. The ink cartridge of claim 7, wherein said barrier comprises a plug sealingly disposed in the port.

9. The ink cartridge of claim 8, wherein said plug comprises:

a. a post extending into the port, said post capable of being pushed by the needle; and b. a flange surrounding said post and integrally attached thereto for covering the port.

10. The ink cartridge of claim 9, wherein said flange has an annular recessed portion therein of reduced strength, so that said post and the annular recessed portion separate from the flange to uncover the port as the needle pushes the post.

11. The ink cartridge of claim 8, wherein said plug comprises a U-shaped portion extending into the port and capable of being pierced by the needle.

12. The ink cartridge of claim 8, wherein said plug comprises a ball sized to be sealingly received in the port.

13. The ink cartridge of claim 7, wherein said barrier comprises a flap having a first portion thereof affixed to the wall of said shell and a second portion thereof movable from a first position covering the port while said barrier is not pushed by the needle to a second position thereof uncovering the port while said barrier is pushed by the needle.

14. The ink cartridge of claim 13, wherein said flap comprises a piston connected to the second portion of said flap and extending into the port, said piston capable of being pushed by the needle, so that the piston moves as the needle pushes the piston and so that the second portion of said flap moves to the second position thereof to uncover the port as said piston moves.

15. The ink cartridge of claim 7, wherein said barrier is adapted to move due to a pressure drop thereacross.

16. A method of assembling a printer ink cartridge, comprising the steps of:

a. providing a shell defining a cavity therein for storing ink and an inlet port allowing access to the cavity;

b. spanning the port with a seal; and c. interposing a barrier between the cavity and the seal for isolating the cavity from the seal to avoid chemical interaction between the ink and said seal, said barrier being permanently removable, as a needle pushes said barriers after the needle pierces said seal, from between the cavity and said seal so that said seal is in communication with the cavity.

17. The method of claim 16, wherein the step of interposing the barrier comprises the step of disposing a plug in the port.

18. The method of claim 16, wherein the step of interposing the barrier comprises the step of covering the port with a flap.

19. A method of assembling a printer ink cartridge, comprising the steps of:

a. providing a shell defining a cavity therein for storing ink and an inlet port allowing access to the cavity;

b. disposing a seal in the port for sealing the port, the seal capable of being pierced therethrough by a needle; and c. interposing a removable barrier between the cavity and the seal, the barrier covering the port for isolating the cavity from the seal to avoid chemical interaction between the ink and said seal, whereby the needle pushes the barrier after the needle pierces the seal, whereby the barrier is permanently removed as the needle pushes the barrier and whereby the barrier uncovers the port as the barrier is removed.

20. The method of claim 19, wherein the step of interposing the barrier comprises the step of disposing a plug sealingly in the port.

21. The method of claim 19, wherein the step of interposing the barrier comprises the step of providing a flap having a first portion thereof affixed to the shell and a second portion thereof movable from a first position covering the port while the barrier is not pushed by the needle to a second position uncovering the port while the barrier is pushed by the needle.

22. A method of assembling a printer ink cartridge, comprising the steps of:

a. providing a shell formed by a wall defining a cavity in the shell for storing ink and defining an inlet port through the wall for allowing access to the cavity;

b. matingly disposing an elastomeric septum in the port for sealing the port, the septum having a first surface and a second surface and a slit therethrough extending from the first surface to the second surface for sealably receiving an ink supply needle; and c. interposing a removable barrier between the cavity and the port, the barrier covering the port for isolating the ink in the cavity from the septum in order to avoid chemical interaction between the ink and the septum, whereby the needle pushes the barrier after the needle is received through the silt, whereby the barrier is permanently removed as the needle pushes the barrier and whereby the barrier uncovers the port as the barrier is removed.

23. The method of claim 22, wherein the step of interposing the barrier comprises the step of sealingly disposing a plug in the port.

24. The method of claim 23, wherein the step of sealingly disposing the plug comprises the steps of:

a. extending a post into the port, the post capable of being pushed by the needle; and b. surrounding and integrally attaching a flange to the post, the flange capable of covering the port.

25. The method of claim 24, wherein the step of surrounding and integrally attaching the flange comprises the step of forming an annular recessed portion in the flange of reduced strength, so that the post and the annular recessed portion separate from the flange to uncover the port as the needle pushes the post.

26. The method of claim 23, wherein the step of disposing the plug comprises the step of disposing a plug member having a U-shaped portion extending into the port, the U-shaped plug member capable of being pierced by the needle.

27. The method of claim 23, wherein the step of disposing the plug comprises the step of disposing a ball sized to be sealingly received in the port.

28. The method of claim 22, wherein the step of interposing the barrier comprises the step of interposing a flap having a first portion thereof affixed to the wall of the shell and a second portion thereof movable from a first position covering the port while the barrier is not pushed by the needle to a second position thereof uncovering the port while the barrier is pushed by the needle.

29. The method of claim 28, wherein the step of interposing the flap comprises the step of connecting a piston to the second portion of the flap, the piston extending into the port and capable of being pushed by the needle, so that the piston moves as the needle pushes the piston and so that the second portion of the flap moves to the second position thereof to uncover the port as the piston moves.

30. The method of claim 22, wherein the step of interposing the barrier comprises the step of providing a barrier adapted to move due to a pressure drop thereacross.

31. A method of refilling a printer ink cartridge with ink, the cartridge including a shell defining a cavity therein for storing the ink and an inlet port allowing access to the cavity, the port having a seal therein spanning the port, the cartridge having a barrier capable of being interposed between the cavity and the seal for isolating the cavity from the seal to avoid chemical interaction between the ink and said seal, said barrier being permanently removable from between the cavity and said seal so that said seal is in communication with the cavity, the method comprising the steps of:

a. disposing an ink supply needle adjacent to the seal;

b. piercing the seal with the ink supply needle, whereby said barrier permanently removed as the needle pushes the barrier; and c. allowing the ink to flow through the needle and into the cavity.

* * * * *

UNITED STATES PATENT AND TRADEMARK OFFICE

CERTIFICATE OF CORRECTION

PATENT NO. : 6,676,252 B2
DATED : January 13, 2004
INVENTOR(S) : Bilotta et al.

Figure 13:
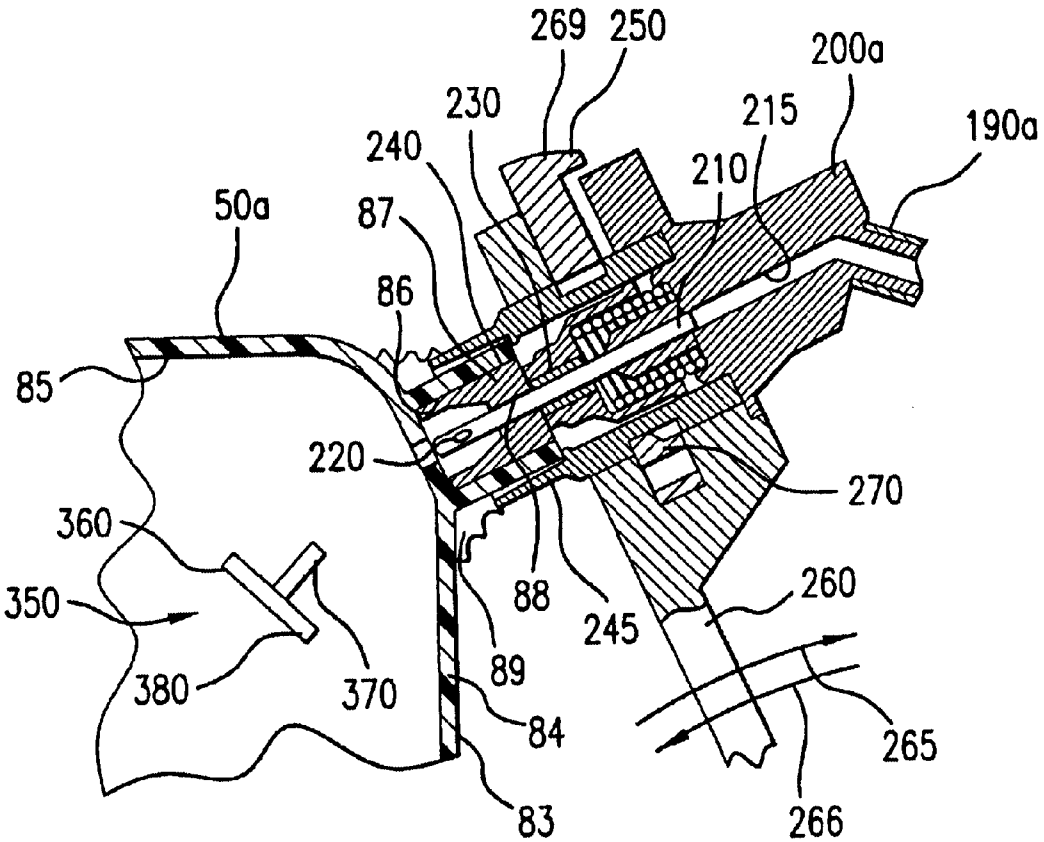
FIG. 13 is a fragmentary view in vertical section of the depleted cartridge, this view showing the first embodiment barrier being removed by the needle as the needle valve assembly engages the depleted cartridge.

It is certified that error appears in the above-identified patent and that said Letters Patent is hereby corrected as shown below:

Column 1,
Line 56, delete “carnage” and insert in lieu thereof -- carriage --;

Column 10,
Line 38, after “only”, delete “one”;
Line 38, insert the following paragraph:

-- Referring to Figs. 12 and 13, the controller detects the low ink level state in any one of cartridges 50a/b/c/d and operates carriage 60 to move carriage along rails 70a/b to refill station 170, as previously mentioned. The controller then operates motor 330 to rotate arm 260, so that valve assembly 200a engages port 86, as previously described. When valve assembly 200a engages port 86, valve collar 230 is pressed up the length of needle 210. This allows the distal end of needle 210 to slide into slit 88 of septum 87 and encounter post 370 of plug 360. As the distal end of needle 210 encounters post 370, the distal end of needle 210 will push post 370 with sufficient force to expel plug 360 from port 86 in order to expose septum 87 (and needle 210) to cavity 85. The negative back pressure in cavity 85 will then "pull" ink through openings 220 of needle 210 and into cavity 85, in the manner described hereinabove. The plug dislodged from port 86 falls to the bottom of cavity 85. After cavity 85 is filled with ink, the controller senses absence of back pressure and operates motor 330 to disengage valve assembly 200a from port 86 as described hereinabove. Spring 240 then biases valve collar 230 to its initial position covering openings 220 of needle 210. Thus, it may be appreciated from the description hereinabove, that plug 360 effectively separates septum 87 from chemical interaction with the ink in cavity 85 until such time as cavity 85 is refilled with ink. --

Line 60, delete “Isolating” and insert in lieu thereof -- isolating --;
Line 63, delete “Ink” and insert in lieu thereof -- ink --;
Line 66, delete “A,though” and insert in lieu thereof -- Although --;

Column 11,
Line 1, delete “Is” and insert in lieu thereof -- is --;
Lines 13 and 14, delete “Ink” and insert in lieu thereof -- ink --;

Column 12,
Line 45, delete “In” and insert in lieu thereof -- in -- and delete “Ink” and insert in lieu thereof -- ink --;
Line 46, after “This”, delete “Is” and insert in lieu thereof -- is -- and after “which”, delete “Is” and insert in lieu thereof -- is --;
Line 47, delete “Interposed” and insert in lieu thereof -- interposed --;
Line 49, delete “Ink” and insert in lieu thereof -- ink --;

UNITED STATES PATENT AND TRADEMARK OFFICE

CERTIFICATE OF CORRECTION

PATENT NO. : 6,676,252 B2
DATED : January 13, 2004
INVENTOR(S) : Bilotta et al.

It is certified that error appears in the above-identified patent and that said Letters Patent is hereby corrected as shown below:

Column 16,
Line 24, delete “silt” and insert in lieu thereof -- slit --.

Signed and Sealed this

Twenty-eighth Day of June, 2005

JON W. DUDAS
*Director of the United States Patent and Trademark Office*